US009181025B2

(12) United States Patent
Graham et al.

(10) Patent No.: US 9,181,025 B2
(45) **Date of Patent: *Nov. 10, 2015**

(54) COLLAPSIBLE CONTAINER AND BLANKS FOR CONSTRUCTING THE SAME

(71) Applicant: Rock-Tenn Shared Services, LLC, Norcoss, GA (US)

(72) Inventors: Thomas D. Graham, Winter Garden, FL (US); Tesfahun Y. Mengistu, Sioux City, IA (US); John Thomas Yoder, IV, Wildwood, MO (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/448,415

(22) Filed: Jul. 31, 2014

(65) Prior Publication Data

US 2014/0339292 A1 Nov. 20, 2014

Related U.S. Application Data

(63) Continuation of application No. 12/728,051, filed on Mar. 19, 2010, now Pat. No. 8,814,031, which is a continuation of application No. 12/102,235, filed on Apr. 14, 2008, now Pat. No. 7,682,300, which is a continuation-in-part of application No. 11/533,244, filed on Sep. 19, 2006, now Pat. No. 7,381,176.

(51) Int. Cl.

| | |
|---|---|
| ***B65D 5/36*** | (2006.01) |
| ***B65D 88/52*** | (2006.01) |
| ***B31B 1/90*** | (2006.01) |
| ***B31B 17/00*** | (2006.01) |
| ***B65D 5/12*** | (2006.01) |
| ***B65D 5/32*** | (2006.01) |

(52) U.S. Cl.
CPC ..... *B65D 88/524* (2013.01); *B31B 1/90* (2013.01); *B31B 17/00* (2013.01); *B65D 5/12* (2013.01);
(Continued)

(58) Field of Classification Search
USPC ..... 229/108.1, 117.02, 122.27, 122.28, 229/122.29, 117.06, 117.01
See application file for complete search history.

(56) References Cited

U.S. PATENT DOCUMENTS 917,384 A * 4/1909 Walker ..... 229/122.28
925,935 A * 6/1909 Miner ..... 229/122.28
(Continued)

FOREIGN PATENT DOCUMENTS

GB 2096971 A 10/1982

OTHER PUBLICATIONS

A Canadian Office Action, dated Aug. 1, 2014, for co-pending CA patent application No. 2,602,987 (3 pgs).
(Continued)

*Primary Examiner* — Christopher Demeree
(74) *Attorney, Agent, or Firm* — Armstrong Teasdale LLP

(57) ABSTRACT

A container configured to be selectively moved between a substantially flat configuration and a deployed configuration is provided. The container includes a plurality of side walls formed from a first blank and a bottom wall formed from a second blank. Each side wall has an end flap extending from a bottom edge of the first blank. The bottom wall is coupled to a first end flap extending from a first side wall of the first blank, and is foldable along a fold line for selectively moving the container from a deployed configuration into a substantially flat configuration. A second end flap extends from a second side wall adjacent the first side wall, and a third end flap extends from a third side wall adjacent the second side wall. The second and third end flaps support the second blank in uncoupled communication when the container is in the deployed configuration.

18 Claims, 23 Drawing Sheets

(52) U.S. Cl.
CPC *B65D 5/321* (2013.01); *B65D 5/36* (2013.01); *B31B 2201/9004* (2013.01); *B31B 2217/0007* (2013.01); *B31B 2217/082* (2013.01)

(56) References Cited

U.S. PATENT DOCUMENTS

| | | | | |
|---|---|---|---|---|
| 1,084,140 | A | | 1/1914 | Fenlason |
| 1,168,565 | A | * | 1/1916 | Rosenwald ..... 229/122.29 |
| 1,341,954 | A | | 6/1920 | Weightman et al. |
| 1,555,054 | A | | 9/1925 | Berkowitz |
| 1,652,844 | A | | 12/1927 | Van Wormer |
| 2,054,473 | A | | 9/1936 | Towell |
| 2,085,238 | A | | 6/1937 | Towell |
| 2,165,906 | A | | 7/1939 | Reich |
| 2,733,852 | A | | 2/1956 | Williamson |
| 2,741,416 | A | | 4/1956 | Hileman |
| 3,000,496 | A | | 9/1961 | Larson |
| 3,014,637 | A | | 12/1961 | Wilson |
| 3,115,292 | A | | 12/1963 | Repking |
| 3,251,533 | A | | 5/1966 | Cohen |
| 3,480,196 | A | | 11/1969 | De Simas |
| 3,482,489 | A | | 12/1969 | Neal et al. |
| 3,531,043 | A | | 9/1970 | Carlsson et al. |
| 3,682,154 | A | | 8/1972 | Mollere |
| 4,166,569 | A | | 9/1979 | Begnaud et al. |
| 4,341,337 | A | | 7/1982 | Beach, Jr. et al. |
| 4,392,606 | A | | 7/1983 | Fremion |
| 4,418,861 | A | | 12/1983 | McFarland et al. |
| 4,461,137 | A | | 7/1984 | Wood |
| 4,702,408 | A | | 10/1987 | Powlenko |
| 4,736,885 | A | | 4/1988 | Negus, Sr. |
| 4,769,970 | A | | 9/1988 | Konno |
| 4,798,571 | A | | 1/1989 | Everman et al. |
| 4,951,562 | A | | 8/1990 | Ribaldo |
| 5,289,668 | A | | 3/1994 | Meyer |
| 5,351,849 | A | | 10/1994 | Jagenburg et al. |
| 5,400,706 | A | | 3/1995 | Tipton et al. |
| 5,715,991 | A | | 2/1998 | Gasper |
| 5,761,889 | A | | 6/1998 | Blaisdell et al. |
| 5,772,108 | A | | 6/1998 | Ruggiere, Sr. et al. |
| 5,915,617 | A | | 6/1999 | Gasper |
| 6,012,629 | A | | 1/2000 | Newcomer |
| 6,074,331 | A | | 6/2000 | Ruggiere, Sr. et al. |
| 6,264,034 | B1 | | 7/2001 | Bacques et al. |
| 6,386,437 | B1 | | 5/2002 | Larson, Jr. |
| 6,688,084 | B2 | | 2/2004 | Yarbrough |
| RE38,631 | E | | 10/2004 | Ruggiere, Sr. et al. |
| 6,918,228 | B2 | | 7/2005 | Yarbrough |
| 7,381,176 | B2 | | 6/2008 | Graham et al. |
| 7,434,721 | B2 | | 10/2008 | Feltz |
| 7,682,300 | B2 | | 3/2010 | Graham et al. |
| 2008/0188364 | A1 | | 8/2008 | Graham et al. |
| 2010/0230479 | A1 | | 9/2010 | Graham et al. |

OTHER PUBLICATIONS

Canadian Office Action, dated Apr. 16, 2015, for co-pending Canadian patent application No. 2,602,987 (3 pgs).

* cited by examiner

COLLAPSIBLE CONTAINER AND BLANKS FOR CONSTRUCTING THE SAME

CROSS REFERENCE TO RELATED APPLICATIONS

This application is a continuation of and claims priority to U.S. patent application Ser. No. 12/728,051, filed Mar. 19, 2010, entitled "Collapsible Container and Blanks for Constructing the Same," which is a continuation of and claims priority to U.S. patent application Ser. No. 12/102,235, filed Apr. 14, 2008, entitled "Method and Machine for Constructing a Collapsible Bulk Bin," now U.S. Pat. No. 7,682,300 issued Mar. 23, 2010, which is a continuation-in-part of and claims priority to U.S. patent application Ser. No. 11/533,244, filed Sep. 19, 2006, entitled "Method and Machine for Constructing a Collapsible Bulk Bin," now U.S. Pat. No. 7,381,176 issued Jun. 3, 2008, which are all hereby incorporated by reference in their entirety.

BACKGROUND OF THE INVENTION

This invention relates generally to packaging and, more particularly, to methods and a machine for constructing a collapsible bulk bin that includes a self-erecting bottom wall.

Containers are frequently utilized to store and aid in transporting products. These containers can be square, hexagonal, or octagonal. At least some known bulk containers used to transport products are designed to fit a standard sized pallet. The shape of the container can provide additional strength to the container. For example, a hexagonal-shaped bulk container provides greater resistance to bulge over conventional rectangular or square containers. An empty bulk bin can be shipped in a knocked-down flat state and opened to form an assembled bulk bin that is ready for use. Shipping and storing bulk bins in a knocked-down flat state saves money and space, however, the size and configuration of bulk bins can make the setup of the bin difficult for an individual to complete and often requires more than one person for assembly. A bulk bin that requires more than one person to complete assembly can cause unwanted expenses and wasted time for a user of the bulk bin.

BRIEF DESCRIPTION OF THE INVENTION

In one aspect, a machine for making a reinforced, collapsible bulk bin assembly is provided. The bulk bin assembly is capable of being erected to a deployed articulated configuration and is formed from a body blank and a bottom blank. The body blank includes major bottom flaps and minor bottom flaps. The bulk bin includes a bottom and a plurality of side panels extending from the bottom. The machine includes a body blank feeding device for providing a body blank from a stack of body blanks, an erecting device for partially erecting the body blank, a folding device for partially folding the bottom blank, and a bottom insertion device for inserting the partially folded bottom blank into the partially erected body blank. The machine also includes first fingers for attaching the major flaps to the bottom blank, second fingers for attaching each minor flap to a major flap of the body blank, wherein the erecting device collapses the partially erected body blank after the body blank is attached to the bottom blank.

In another aspect, a method for making a reinforced, collapsible bulk bin assembly is provided. The bulk bin assembly is capable of being erected to a deployed articulated configuration and is formed from a body blank and a bottom blank. The body blank includes major bottom flaps and minor bottom flaps. The bulk bin includes a bottom and a plurality of side panels extending from the bottom. The method includes providing a body blank from a stack of body blanks, partially erecting the body blank, partially folding the bottom blank, and inserting the partially folded bottom blank into the partially erected body blank. The method also includes attaching the major flaps of the body blank to the bottom blank, collapsing the partially erected body blank, and attaching each minor flap to a major flap of the body blank after the blank has been collapsed.

In another aspect, a machine for making a reinforced, collapsible bulk bin assembly is provided. The bulk bin assembly is capable of being erected to a deployed articulated configuration and is formed from a body blank and a bottom blank. The body blank includes major bottom flaps and minor bottom flaps. The bulk bin includes a bottom and a plurality of side panels extending from the bottom. The machine includes a body blank feeding device for providing a body blank from a stack of body blanks, an erecting device for partially erecting the body blank, a folding device for partially folding a bottom blank, and a bottom insertion device for inserting the partially folded bottom blank into the partially erected body blank. The machine also includes a first attachment device for attaching the major flaps to the bottom blank, a second attachment device for attaching each minor flap to a major flap of the body blank, wherein the erecting device collapses the partially erected body blank after the body blank is attached to the bottom blank.

BRIEF DESCRIPTION OF THE DRAWINGS

Corresponding reference characters indicate corresponding parts throughout the several views of the drawings.

DETAILED DESCRIPTION OF THE INVENTION

A collapsible bulk bin and methods of constructing a collapsible bulk bin are described herein. More specifically, a collapsible bulk bin, including reinforcing straps and a self-erecting solid bottom wall, and methods of constructing the same are described herein. However, it will be apparent to those skilled in the art and guided by the teachings herein provided that the invention is likewise applicable to any storage container including, without limitation, a carton, a tray, a box, or a bin.

In one embodiment, the container is fabricated from a paperboard material. The container, however, may be fabricated using any suitable material, and therefore is not limited to a specific type of material. In alternative embodiments, the container is fabricated using cardboard, corrugated board, plastic, and/or any suitable material known to those skilled in the art and guided by the teachings herein provided. The container may have any suitable size, shape, and/or configuration (i.e., number of sides), whether such sizes, shapes, and/or configurations are described and/or illustrated herein. For example, in one embodiment, the container includes a shape that provides functionality, such as a shape that facilitates transporting the container and/or a shape that facilitates stacking and/or arranging a plurality of containers.

The container is fabricated from a first blank of sheet material for forming the sides of the container and end flaps for supporting a bottom of the container, and a second blank of sheet material for forming the bottom of the container. In one embodiment, the second blank is coupled to at least one end flap of the first blank in order to attach the bottom of the container to the sides of the container. In an alternative embodiment, the first blank includes at least one slot located near the bottom of the first blank, and the second blank includes at least one tab that corresponds to the at least one slot such that when the second blank is positioned within the first blank to form the bottom of the container, the tab(s) are inserted into the corresponding slot(s) to facilitate attaching the bottom of the container to the sides of the container.

Figure 1:
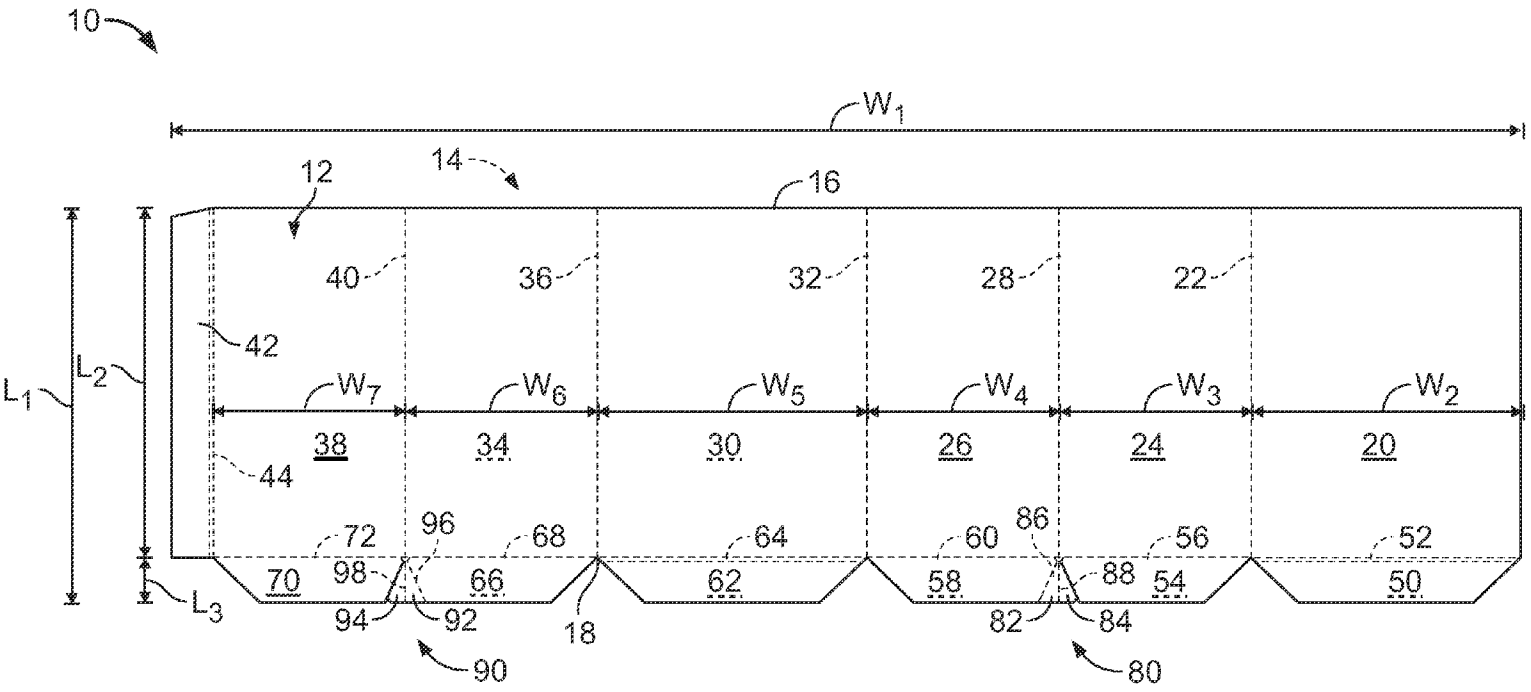
FIG. 1 is a top plan view of a first blank of sheet material for forming a container according to one embodiment of this invention.

Referring now to the drawings, FIG. 1 is a top plan view of a first blank of sheet material 10 for forming a container according to one embodiment of this invention. Specifically, blank 10 is a body blank utilized to form a body of the container. In one embodiment, blank 10 is made of cardboard, corrugated board, plastic, and/or any suitable material. Further, in one embodiment, blank 10 has a width $W_1$ of 149.5 inches and a length $L_1$ of 44 inches. Blank 10 includes an interior surface 12 and an exterior surface 14. Blank 10 also includes a top edge 16 and a bottom edge 18. Blank 10 includes a first side panel 20, coupled across a fold line 22, to a second side panel 24. In one embodiment, first side panel 20 has a width $W_2$ of 29.5 inches and a length $L_2$, and second side panel 24 has a width $W_3$ of 21.5 inches and a length $L_2$. Further, blank 10 includes a third side panel 26, coupled across a fold line 28, to second side panel 24. In one embodiment, third side panel 26 has a width $W_4$ of 21.5 inches and a length $L_2$. Blank 10 also includes a fourth side panel 30, coupled across a fold line 32, to third side panel 26, and a fifth side panel 34, coupled across a fold line 36, to fourth side panel 30. In one embodiment, fourth side panel 30 has a width $W_5$ of 29.5 inches and a length $L_2$, and fifth side panel 34 has a width $W_6$ of 21.5 inches and a length $L_2$. Blank 10 also includes a sixth side panel 38, coupled across a fold line 40, to fifth side panel 34. In one embodiment, sixth side panel 38 has a width $W_7$ of 21.5 inches and a length $L_2$. Sixth side panel 38 includes a glue tab 42 extending across a fold line 44 from an edge opposed to fifth side panel 34. In one embodiment, glue tab 42 has a width $W_8$ of four inches and a length $L_2$, and fold line 44 has a width $W_9$ of one half inch and a length $L_2$.

Blank 10 also includes a plurality of end flaps or major flaps. A first end flap 50 extends from bottom edge 18 of first side panel 20 across a fold line 52. In one embodiment, a portion of first end flap 50 extends a length $L_3$ of five inches from first side panel 20. A second end flap 54 extends from bottom edge 18 of second side panel 24 across a fold line 56. In one embodiment, a portion of second end flap 54 extends length $L_3$ from second side panel 24. A third end flap 58 extends from bottom edge 18 of third side panel 26 across a fold line 60. In one embodiment, a portion of third end flap 58 extends length $L_3$ from third side panel 26. A fourth end flap 62 extends from bottom edge 18 of fourth side panel 30 across a fold line 64. In one embodiment, a portion of fourth end flap 62 extends length $L_3$ from fourth side panel 30. A fifth end flap 66 extends from bottom edge 18 of fifth side panel 34 across a fold line 68. In one embodiment, a portion of fifth end flap 66 extends length $L_3$ from fifth side panel 34. A sixth end flap 70 extends from bottom edge 18 of sixth side panel 38 across a fold line 72. In one embodiment, a portion of sixth end flap 70 extends length $L_3$ from sixth side panel 38.

In alternative embodiments, blank 10 and any portions thereof have any dimensions suitable for forming a bulk bin as described herein.

As shown in FIG. 1, third end flap 58 includes a tab joint or minor flap 80, having a first portion 82 and a second portion 84. First portion 82 is coupled to third end flap 58 across a fold line 86, and second portion 84 is coupled to first portion 82 across a fold line 88. Further, fifth end flap 66 includes a tab joint or minor flap 90 having a first portion 92 and a second portion 94. First portion 92 is coupled to fifth end flap 66 across a fold line 96, and second portion 94 is coupled to first portion 92 across a fold line 98.

Figure 2:
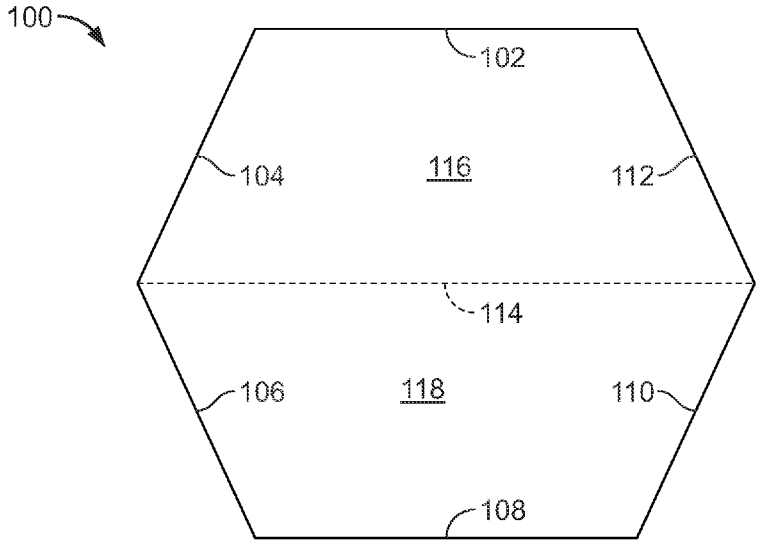
FIG. 2 is a top plan view of a second blank of sheet material for forming a container according to one embodiment of this invention.

FIG. 2 is a top plan view of a second blank of sheet material 100 for forming a container according to one embodiment of this invention. Specifically, blank 100 is a bottom blank utilized to form the container. In one embodiment, blank 100 is a hexagonal shaped blank of sheet material. Blank 100 includes a first edge 102, a second edge 104, a third edge 106, a fourth edge 108, a fifth edge 110, and a sixth edge 112. Blank 100 includes a fold line 114, connecting the junction of second edge 104 and third edge 106 with the junction of fifth edge 110 and sixth edge 112. Fold line 114 separates blank 100 into a first portion 116 and a second portion 118.

Figure 3:
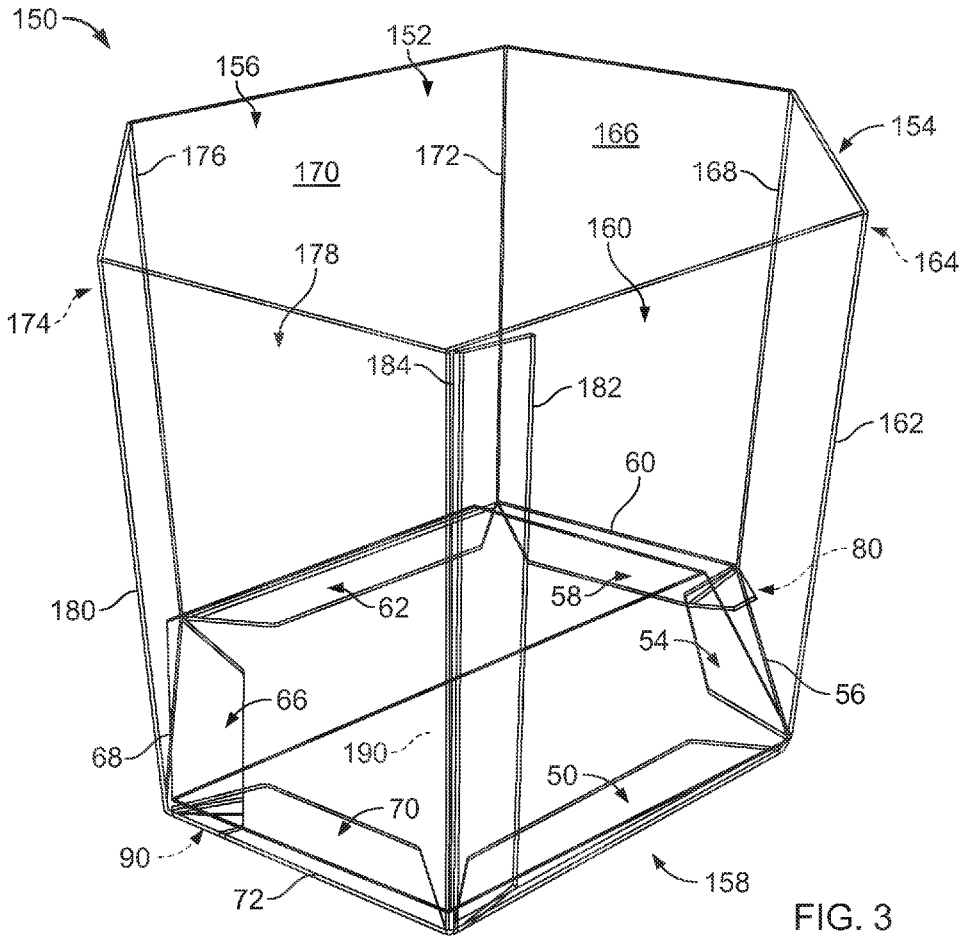
FIG. 3 is a perspective view of the container formed from the first and second blanks as shown in FIGS. 1 and 2.

FIG. 3 is a perspective view of a container 150 formed from first blank 10 of FIG. 1 and second blank 100 of FIG. 2. Container 150 includes an interior 152 and an exterior 154. Container 150 also includes a top opening 156 and a bottom portion 158. Container 150 includes a first side wall 160, coupled across a fold line 162, to a second side wall 164. Container 150 includes a third side wall 166, coupled across a fold line 168, to second side wall 164. Container 150 includes a fourth side panel 170, coupled across a fold line 172, to third side wall 166. Container 150 includes a fifth side wall 174, coupled across a fold line 176, to fourth side wall 170. Container 150 includes a sixth side wall 178, coupled across a fold line 180, to fifth side wall 174. Sixth side wall 178 includes a glue tab 182 extending across a fold line 184, from an edge opposed to fifth side wall 174. Interior 152 of glue tab 182 is coupled to exterior 154 of first side wall 160. In one embodiment, glue tab 182 is adhesively coupled to first side wall 160 using glue. However, any other chemical or mechanical fastener is acceptable for this coupling and any others described below.

Referring further to FIG. 3, blank 100 of FIG. 2 is aligned to form a bottom wall 190. The plurality of end flaps 50, 54, 58, 62, 66, and 70 hold bottom wall 190 within container 150. An interior surface of first bottom flap 50 is coupled to an exterior surface of bottom wall 190. An interior surface of fourth bottom flap 62 is coupled to the exterior surface of bottom wall 190. An interior surface of tab joint 80 is coupled to an exterior surface of second end flap 54 and an interior surface of tab joint 90 is coupled to an exterior surface of sixth end flap 70. The combination of coupling end flaps 50 and 62 to bottom wall 190, and coupling tab joint 80 to end flap 54 and tab joint 90 to end flap 70, holds bottom wall 190 within container 150.

In one embodiment, container 150 may include a liner made of plastic or a similar material for providing a moisture-resistant barrier. Bottom wall 190 is configured to not puncture or cut such liner, which may be placed within container 150. In one embodiment, bottom wall 190 is a solid one-piece construction that has a substantially smooth internal surface. In one embodiment, the internal surface of bottom wall 190 does not include any slits, slots, die-cuts corners, or edges that may pierce or puncture a liner that is positioned within the container.

In one embodiment, bottom wall 190 comprises a single-wall bottom. This design allows a manufacturer to use less material in constructing the bulk container. Because these types of bulk containers are designed to be placed on a pallet for carrying the container, a single-wall construction for bottom wall 190 can be used. In some embodiments, bottom wall 190 is a single-wall bottom and sides 160, 170, 164, 166, 174, and 178 are thicker than bottom wall 190. For example, the sides can be double-wall or triple-wall sides.

Figure 4:
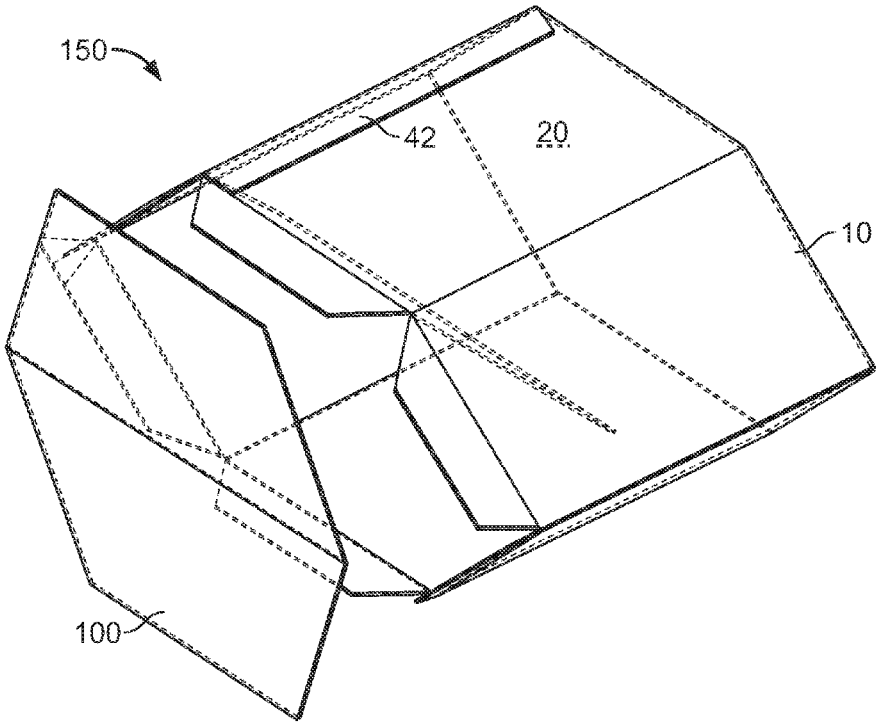
FIG. 4 is a perspective view of the first blank and the second blank in one step of assembly.

FIGS. 4-8 illustrate one exemplary method of assembling container 150. FIG. 4 is a perspective view of first blank 10 and second blank 100 in one step of assembly. Specifically, first blank 10 has been folded such that glue tab 42 is coupled to first side panel 20 to form a hexagonal body, and the hexagonal body is partially erected such that second blank 100 can be inserted therein.

Figure 5:
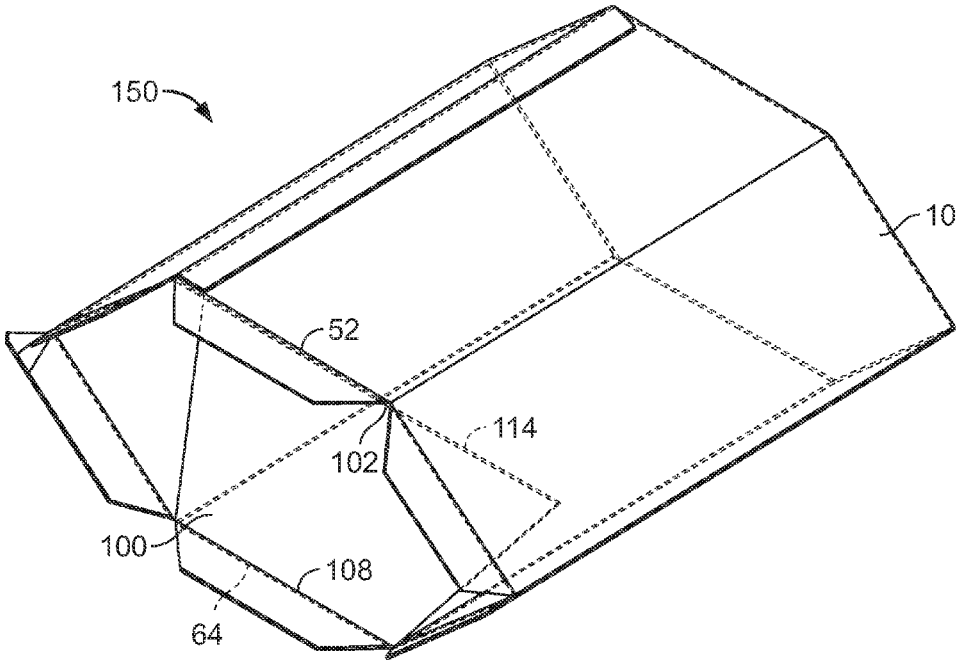
FIG. 5 is a perspective view of the first blank and the second blank in another step of assembly.

FIG. 5 is a perspective view of first blank 10 and second blank 100 in another step of assembly. Second blank 100 is folded substantially ninety degrees along fold line 114 and is inserted into blank 10. Specifically, edge 108 of second blank 100 is aligned with fold line 64 of first blank 10, and edge 102 of second blank 100 is aligned with fold line 52 of first blank 10.

Figure 6:
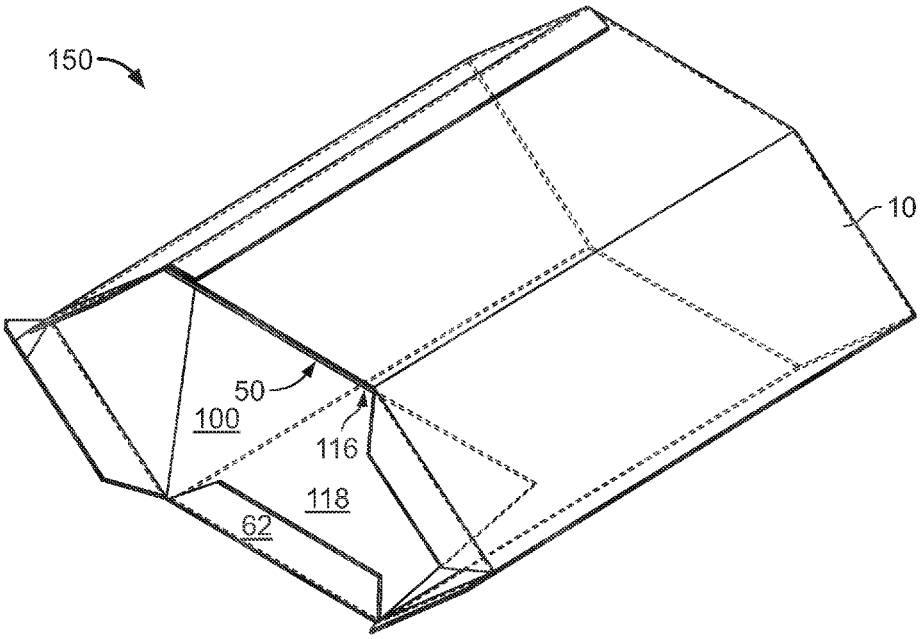
FIG. 6 is a perspective view of the first blank and the second blank in another step of assembly.

FIG. 6 is a perspective view of first blank 10 and second blank 100 in another step of assembly. Major flap 62 of first blank 10 is folded towards and adhered to panel 118 of second blank 100. Further, major flap 50 of first blank 10 is folded towards and adhered to panel 116 of second blank 100.

Figure 7:
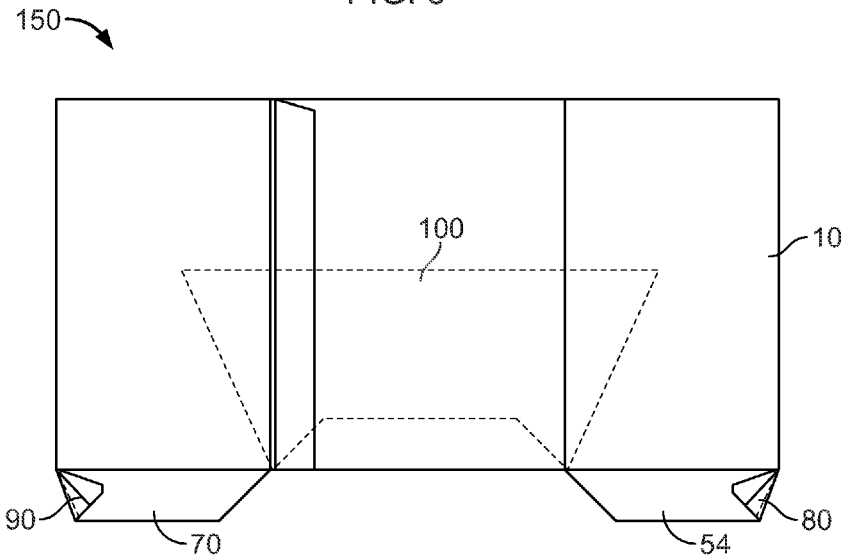
FIG. 7 is a plan view of the first blank and the second blank in another step of assembly.

FIG. 7 is a plan view of first blank 10 and second blank 100 in another step of assembly. First blank 10 is in a collapsed configuration with second blank 100 coupled thereto and positioned therein. Minor flap 90 is folded towards and adhered to major flap 70, and minor flap 80 is folded towards and adhered to major flap 54.

Figure 8:
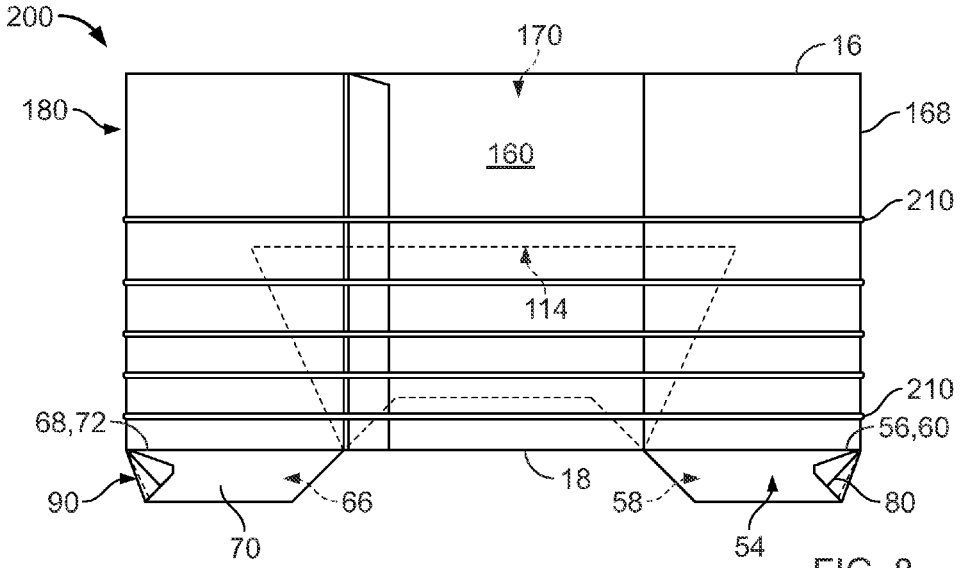
FIG. 8 is a plan view of the container of FIG. 3 in a knocked-down flat configuration and including reinforcing straps.

FIG. 8 is a plan view of an assembled knocked-down flat 200 created from blank 10 (shown in FIG. 1) and blank 100 (shown in FIG. 2) and having a plurality of reinforcing straps 210 wrapped around an exterior surface thereof. Knocked-down flat 200 requires a great deal less space to store, and less space to transport, than fully assembled container 150 (shown in FIG. 3). However, before use, knocked-down flat 200 must be articulated into a usable container. In a first embodiment, to form container 150 from knocked-down flat 200, first side wall 160 is moved out of communication with fourth side wall 170. In one embodiment, top edge 16 of first side wall 160 is pulled away from top edge 16 of fourth side wall 170. In another embodiment, bottom edge 18 of first side wall 160 is pulled away from bottom edge 18 of fourth side wall 170. In yet another embodiment, fold line 168 is pushed toward fold line 180, forcing first side wall 160 apart from fourth side wall 170.

Moving first side wall 160 out of communication with fourth side wall 170 causes blank 100 to rotate about fold line 114, removing first portion 116 (shown in FIG. 2) from communication with second portion 118 (shown in FIG. 2). Moving first side wall 160 out of communication with fourth side wall 170 also removes second end flap 54 from planar communication with third end flap 58. However, tab joint 80 remains coupled to second end flap 54. Second end flap 54 and third end flap 58 rotate about fold lines 56 and 60 respectively, into a substantially perpendicular relationship to side walls 164 and 166 (shown in FIG. 3). When fully articulated, blank 100 is in communication with, and supported by, interior surface 12 (shown in FIG. 1) of end flaps 54 and 58, which are coupled by tab joint 80.

Moving first side wall 160 out of communication with fourth side wall 170 also removes fifth end flap 66 from planar communication with sixth end flap 70. However, tab joint 90 remains coupled to sixth end flap 70. Fifth end flap 66 and sixth end flap 70 rotate about fold lines 68 and 72 respectively, into a substantially perpendicular relationship to side panels 174 and 178 (shown in FIG. 3). When fully articulated, blank 100 is in communication with, and supported by, interior surface 12 (shown in FIG. 1) of end flaps 66 and 70, which are coupled by tab joint 90.

This articulating process can be performed by a single person and without special equipment. By only requiring a single person, employment expenses may be reduced. Also, the time necessary to articulate an assembled container from a knocked-down flat may be reduced, which increases productivity. These benefits are achieved while providing a structurally stable container.

Figure 9:
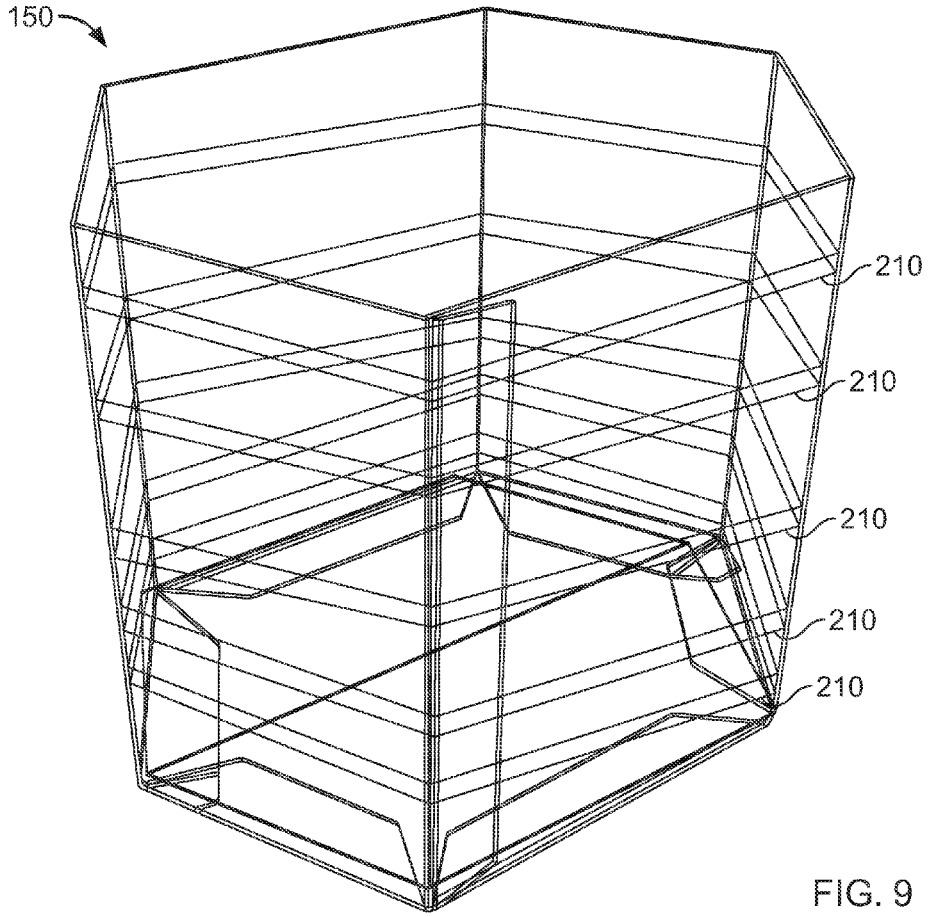
FIG. 9 is a perspective view of the container of FIG. 3, including reinforcing straps.

FIG. 9 is a perspective view of an assembled knocked-down flat 200 created from blank 10 and blank 100 and including reinforcing straps 210. When articulated container 150 is filled with a product to be stored or transported, the product applies pressure to the walls of container 150. One method of reinforcing container 150 to prevent outward bowing of the walls of container 150, is to wrap reinforcing straps 210 around container 150. In one specific example, the straps are made of plastic, but any other material of suitable strength could be utilized.

In one embodiment, the reinforcing straps are flexible plastic straps for providing girth support when the container is in an erected position. The straps are frictionally held in tension around the container vertical side walls. The girth support is provided by the horizontally placed straps at longitudinally spaced locations along the panels. In one embodiment, the straps are polypropylene plastic or of a polyester-type material which are thermally fused or welded together at their ends which secures the straps in sufficient tension outside the container panels for frictionally holding the straps to the container. In one embodiment, the plastic straps include prestretched polypropylene straps, prestretched to provide a low elongation factor and preferably to reduce a typical stretching by approximately fifty percent.

Figure 10:
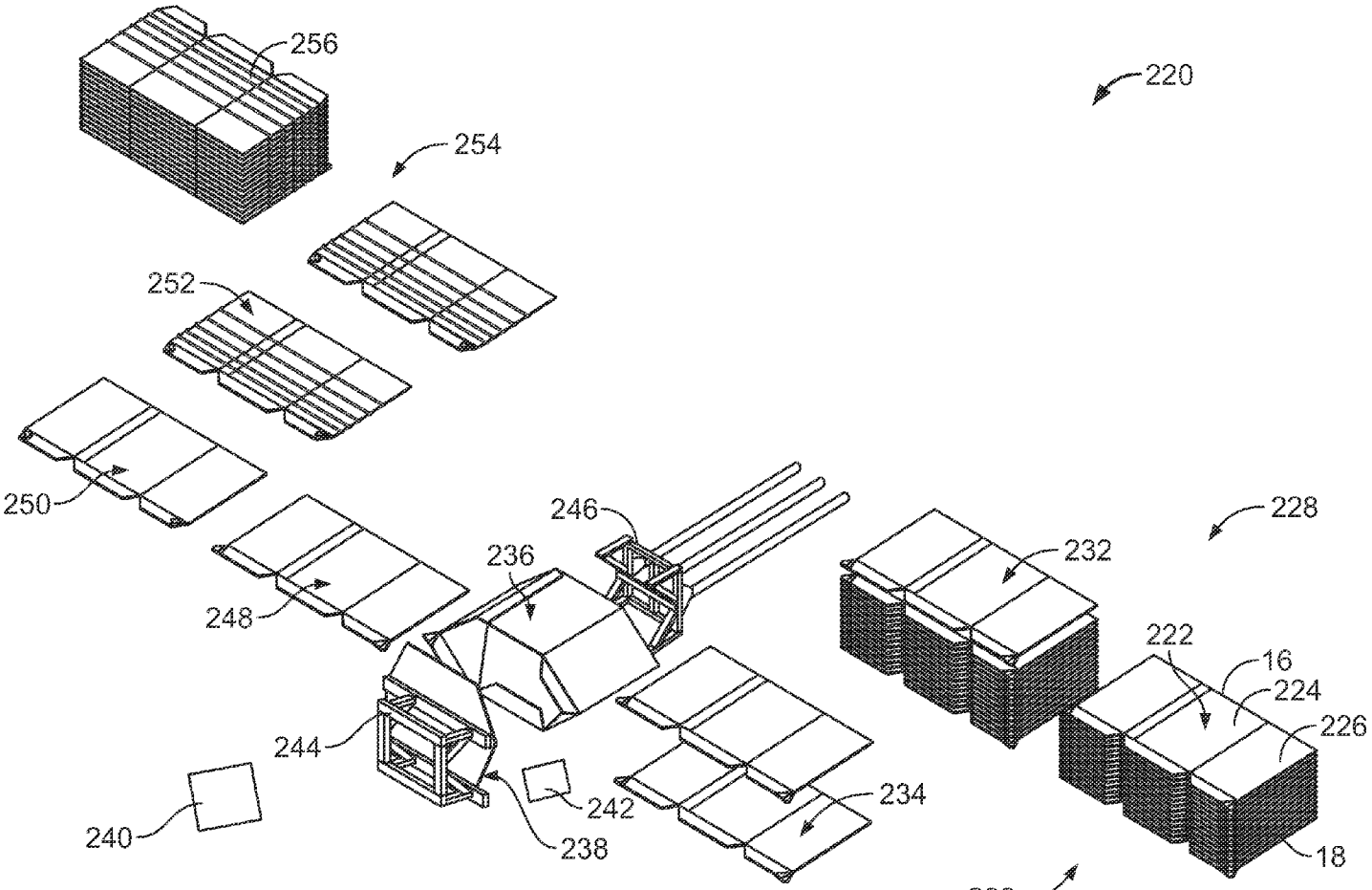
FIG. 10 is a schematic illustration of a mechanism for producing a knocked-down flat, and applying reinforcing straps around the knocked-down flat.

FIG. 10 is a schematic illustration of an exemplary method of forming knocked-down flat 200, and a mechanism to perform the method. More specifically, FIG. 10 is a schematic illustration of a machine 220 for producing knocked-down flat 200 and applying reinforcing straps 210 around knocked-down flat 200.

Machine 220 includes a bin body pre-stage station 222, for receiving a stack of bin body blanks 224 (i.e., first blank of sheet material 10 of FIG. 1). Stack 224 includes a plurality of individual bin body blanks 226. In one embodiment, stack 224 includes eighty-eight bin body blanks 226. In an alternative embodiment, stack 224 includes any suitable number of blanks that may be formed by machine 220. In operation, an individual body blank 226 is provided to machine 220 for forming knocked-down flat 200. Stack 224 is provided to machine 220 with top edges 16 aligned with a first side 228 of machine 220, and bottom edges 18 aligned with a second side 230 of machine 220.

Machine 220 also includes a transport mechanism to move stack 224 to bin body feed station 232. In one embodiment, the transport mechanism includes at least one of a powered conveyor, rollers, and any other mechanism suitable for moving stack 224 as described herein. Bin body feed station 232 includes a scissor lift to lift stack 224 towards a vacuum. The vacuum utilizes suction to remove one blank 226 from stack 224. Blank 226 is then moved by the vacuum to a squaring station 234. As each blank 226 is removed from stack 224, the scissor lift lifts the remaining blanks 226 on stack 224, such that the next blank 226 can be removed from stack 224 by the vacuum. The blank 226 that has been moved to squaring station 234 is squared and lowered to a plurality of rollers. The plurality of rollers then move blank 226 into an erecting station 236.

As each blank 226 is placed on squaring station 234 a bottom pad or bottom blank 238 (i.e., second blank of sheet material 100 of FIG. 2) is removed from a bottom pad magazine 240 and prepared for insertion into blank 226. While bottom pad 238 is positioned between bottom pad magazine 240 and erecting station 236, a glue applicator gun 242 applies glue to predetermined locations of bottom pad 238.

At erecting station 236, an erecting device partially erects blank 226 such that bottom pad 238 can be inserted therein. In one embodiment, the erecting device includes a pair of vacuums for suctioning a top portion and a bottom portion of blank 226. Further, bottom pad 238 is folded to a substantially ninety degree angle to provide a female end and a male end. An insertion mechanism 244 located at erecting station 236 is inserted into the female end of folded bottom pad 238, such that insertion mechanism 244 forces the male end of bottom pad 238 toward an opening in the partially erect blank 226. Insertion mechanism 244 continues to insert bottom pad 238 until bottom pad 238 is positioned entirely within blank 226. A first attachment device then folds at least one major flap toward the glued portions of bottom pad 238 and a compression device 246 applies pressure to the portions of bottom pad 238 having glue thereon. As such, the glued portions of bottom pad 238 are forced against blank 226, such that bottom pad 238 is secured to blank 226 to form knocked-down flat 200. In one embodiment, the first attachment device includes a plurality of fingers.

Knocked-down flat 200 is then transported to a collapsing station 248 where knocked-down flat 200 is collapsed with bottom pad 238 glued within blank 226. A plurality of rollers then transport knocked-down flat 200 to a tab joint or minor flap sealing station 250. Glue is applied to tab joints 80 and 90 and a second attachment device folds tab joints 80 and 90 such that they are sealed against second end flap 54 and sixth end flap 70, respectively. In one embodiment, the second attachment device includes a plurality of fingers. Knocked-down flat 200 is then transferred to a strapping station 252 where a plurality of straps are applied around knocked-down flat 200. Knocked-down flat 200 is then placed on a unitizing station 254 to be stacked with other knocked-down flats 200. Knocked-down flats 200 are positioned on unitizing station 254 in an alternating configuration. Specifically, a first flat 200 is positioned such that top edge 16 is aligned with first side 228 of machine 220. A second flat 200 is then positioned on top of the first flat with bottom edge 18 aligned with first side 228 of machine 220. By alternating flats 200, the weight of flats 200 is distributed to facilitate forming a level stack 256.

Strapping station 252 may be configured to apply the straps in a plurality of locations on knocked-down flat 200. For example, in one embodiment, the plurality of straps are simultaneously applied around knocked-down flat 200 in strapping station 252. In an alternative embodiment, strapping station 252 applies one of the plurality of straps at a time to flat 200. In the alternative embodiment, flat 200 is positioned at a first location within strapping station 252 such that a first strap (i.e., the strap farthest away from the bottom of the container) is applied to flat 200. The conveyor transporting flat 200 is then moved to a second location within strapping station 252 such that a second strap (i.e., the strap second farthest away from the bottom of the container) is applied to flat 200. This step-by-step process of applying a strap at a location increasingly closer to the bottom of the container is repeated until all of the straps are applied. In the example embodiment, at least five straps are applied to flat 200.

The locations of the straps on the flat can vary in distance between each strap or can be the same distance between each strap. For example, numbering the straps #1, #2, #3, #4, and #5 (where #1 is the strap farthest from the bottom of the container and #5 is the strap closest to the bottom of the container), the distance between strap #1 and strap #2 is distance X, while the distance between straps #2 and #3, and between straps #3 and #4, and between straps #4 and #5 is distance Y, wherein distance X is greater than distance Y in order to provide support to the container. In another embodiment, the distance between each strap going from strap #1 to strap #5 becomes increasingly smaller.

Figure 11:
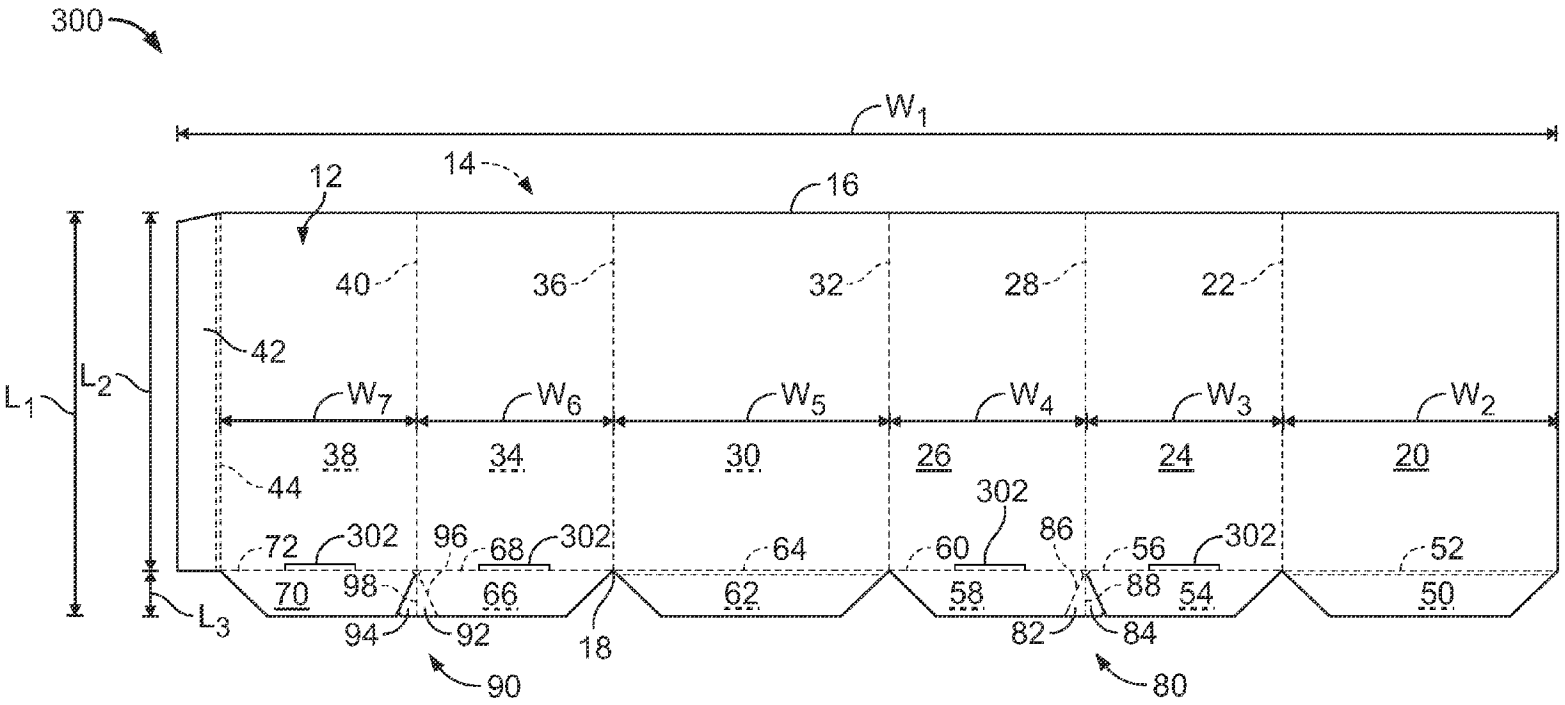
FIG. 11 is a top plan view of an alternative first blank of sheet material for forming an alternative embodiment of a container shown herein.

FIG. 11 is a top plan view of an alternative first blank 300 of sheet material for forming an alternative embodiment of the container shown herein. Specifically, blank 300 is an alternative embodiment of the first blank shown in FIG. 1. The portions of blank 300 that are the same as the portions of the first blank shown in FIG. 1 are identified using the same numerical references.

Blank 300 includes at least one slot 302 or cutout on at least one of the side panels. In the example embodiment, slot 302 is located on second side panel 24, third side panel 26, fifth side panel 34 and sixth side panel 38. Slot 302 is positioned near the bottom of the side panel slightly above the transverse fold line of the corresponding end flap. Slot 302 is sized to receive a tab included on the alternative second blank discussed below.

Figure 12:
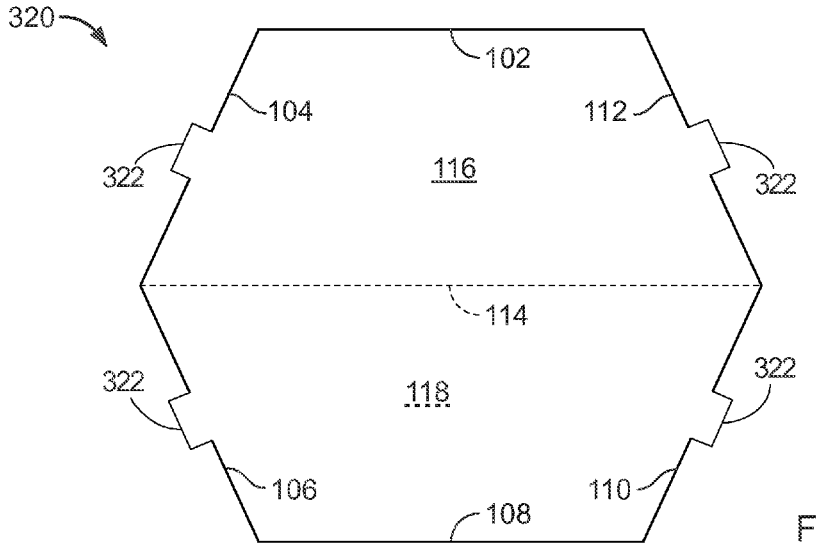
FIG. 12 is a top plan view of an alternative second blank of sheet material for forming an alternative embodiment of a container shown herein.

FIG. 12 is a top plan view of an alternative second blank 320 of sheet material for forming an alternative embodiment of the container shown herein. Specifically, blank 320 is an alternative embodiment of the second blank shown in FIG. 2. The portions of blank 320 that are the same as the portions of the second blank shown in FIG. 2 are identified using the same numerical references.

Blank 320 includes at least one tab 322 on at least one of the edges. In the example embodiment, tab 322 is located on second edge 104, third edge 106, fifth edge 110 and sixth edge 112. Each tab 322 is configured to be received within corresponding slot 302 on the side panels of the container. In other words, in the alternative embodiment of the container and as discussed in greater detail below, blank 300 is folded and glued to form the sides of the container. Blank 320 is then inserted within formed blank 300 and each tab 322 is inserted within corresponding slots 302 to facilitate coupling the bottom of the container to the sides of the container. In addition, blank 320 is further coupled to blank 300 as described in the embodiment of the container shown in FIG. 3.

Figure 13:
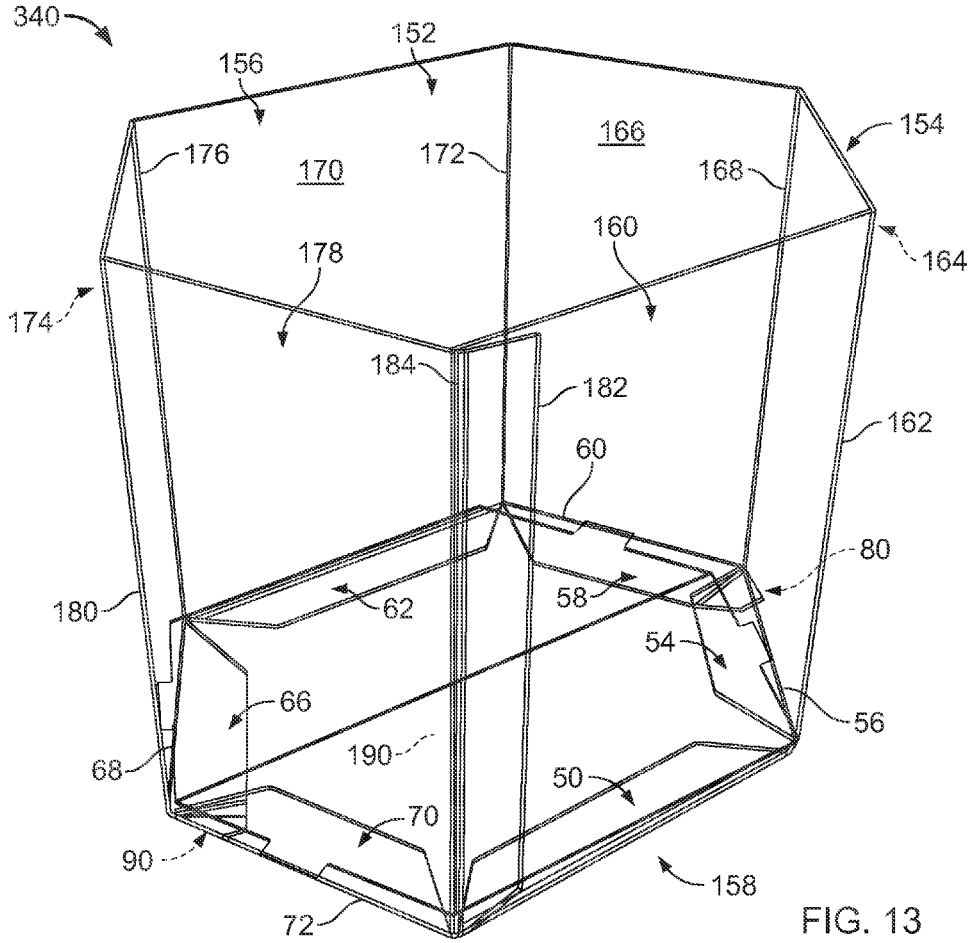
FIG. 13 is a perspective view of the alternative container formed from the alternative first and second blanks as shown in FIGS. 11 and 12.

FIG. 13 is a perspective view of an alternative container 340 formed from alternative first blank 300 of FIG. 11 and alternative second blank 320 of FIG. 12. Container 340 includes tabs 322 and slots 302 for securing blank 320, the bottom of the container, to blank 300, the sides of the container.

Figure 14:
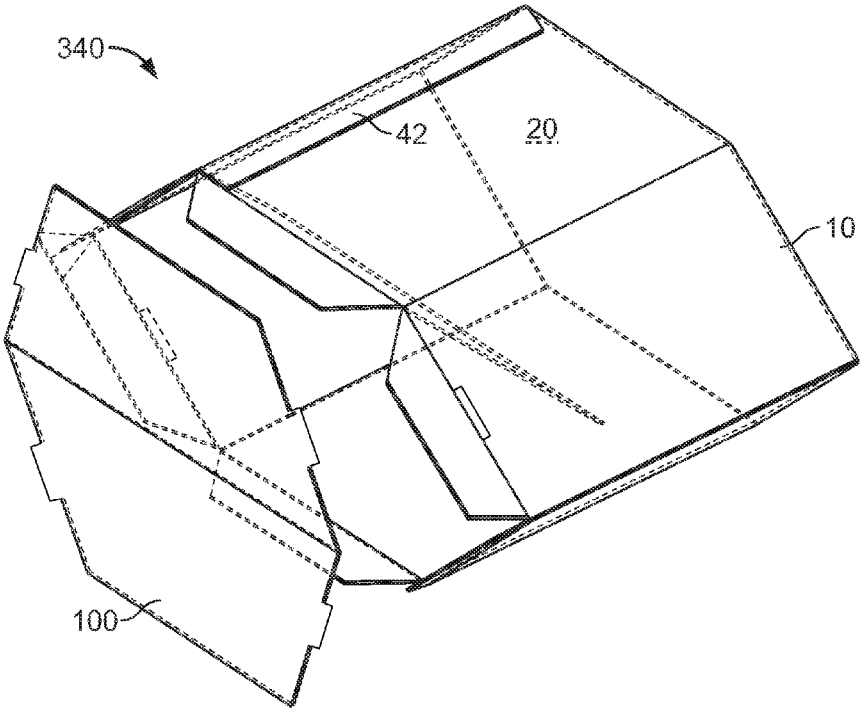
FIG. 14 is a perspective view of the alternative first blank and the alternative second blank in one step of assembly.
Figure 15:
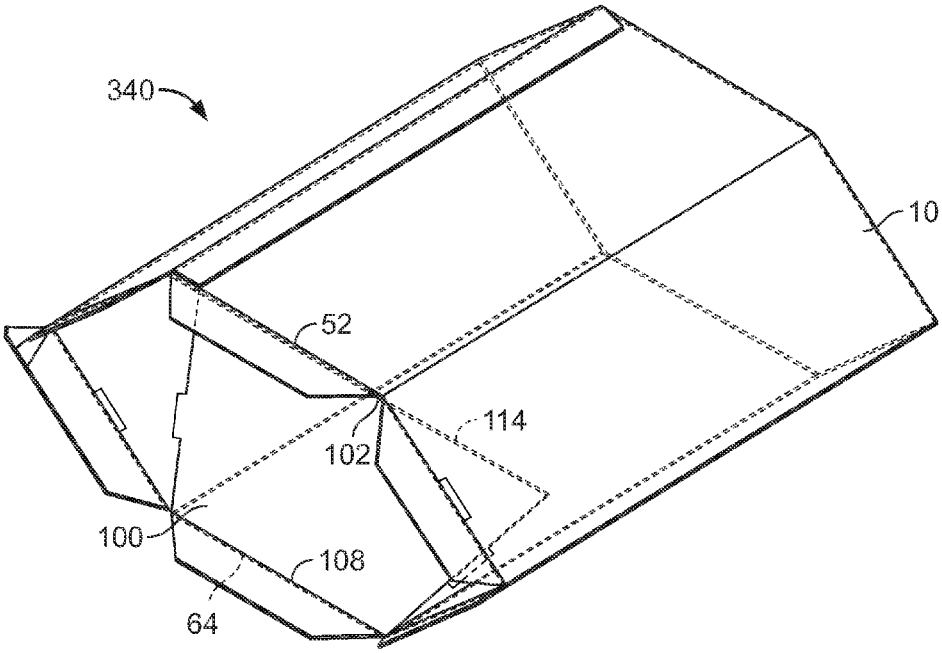
FIG. 15 is a perspective view of the alternative first blank and the alternative second blank in another step of assembly.
Figure 16:
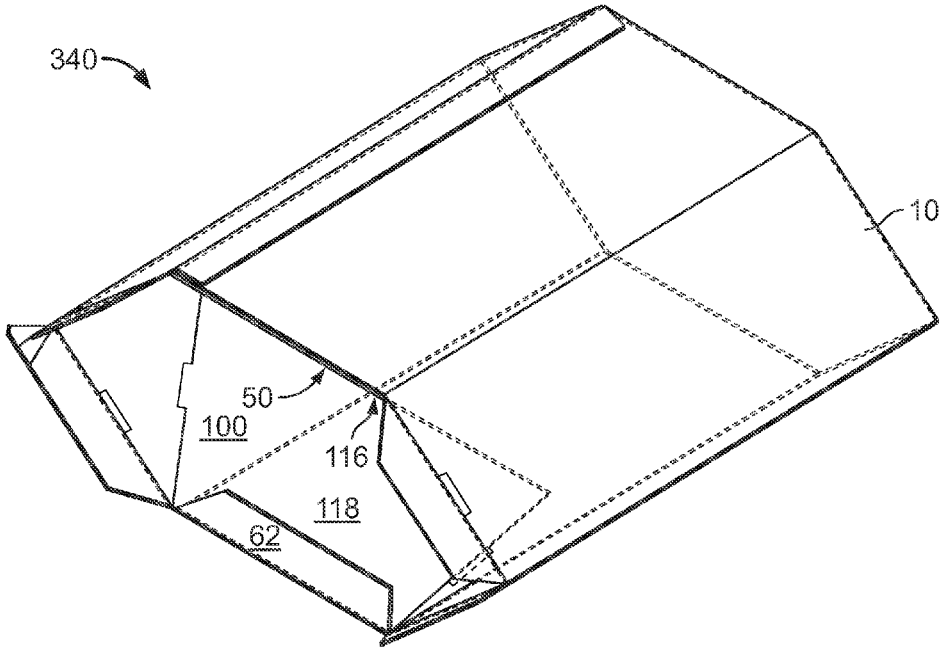
FIG. 16 is a perspective view of the alternative first blank and the alternative second blank in another step of assembly.
Figure 17:
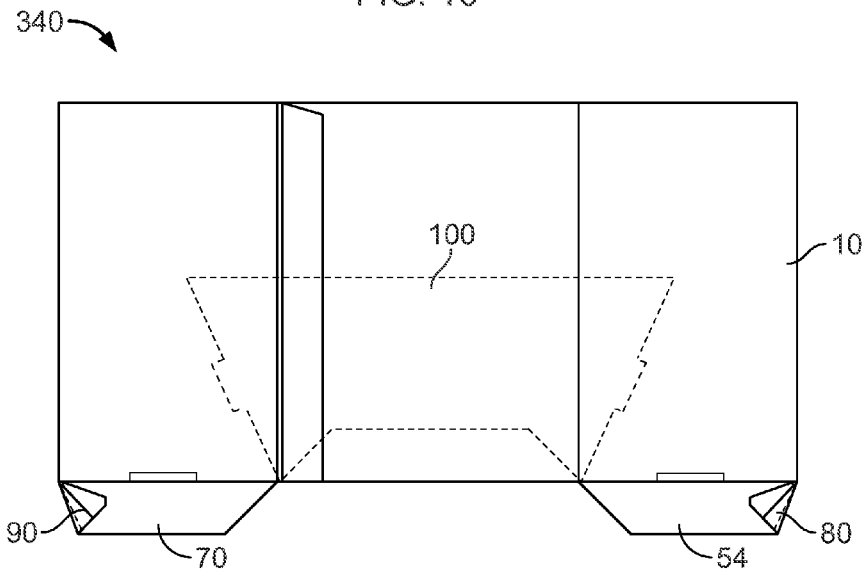
FIG. 17 is a plan view of the alternative first blank and the alternative second blank in another step of assembly.
Figure 18:
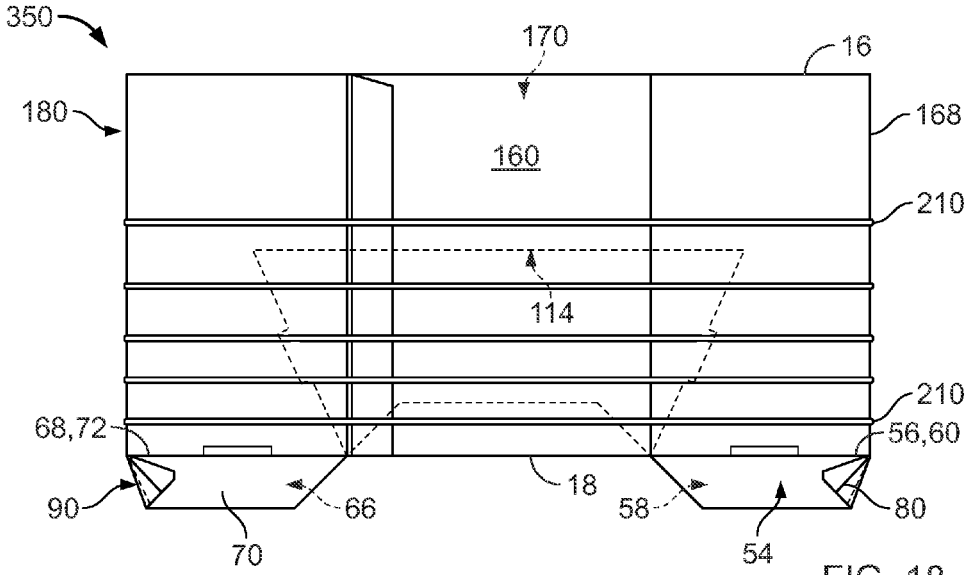
FIG. 18 is a plan view of the container of FIG. 13 in a knocked-down flat configuration and including reinforcing straps.

FIGS. 14-18 illustrate one exemplary method of assembling container 340. FIG. 14 is a perspective view of alternative first blank 300 and alternative second blank 320 in one step of assembly. FIG. 15 is a perspective view of alternative first blank 300 and alternative second blank 320 in another step of assembly. FIG. 16 is a perspective view of alternative first blank 300 and alternative second blank 320 in another step of assembly. FIG. 17 is a plan view of alternative first blank 300 and alternative second blank 320 in another step of assembly. FIG. 18 is a plan view of container 340 of FIG. 13 in a knocked-down flat 350 configuration and including reinforcing straps.

Figure 19:
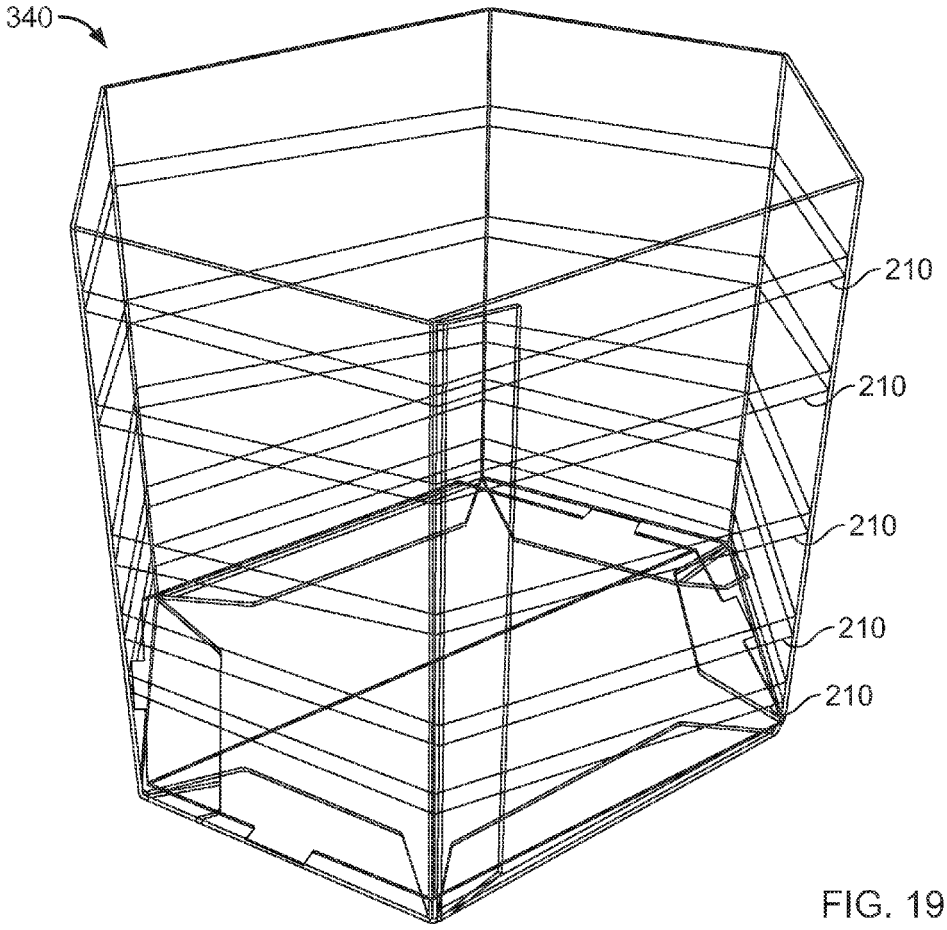
FIG. 19 is a perspective view of the alternative container of FIG. 13, including reinforcing straps.

FIG. 19 is a perspective view of container 340 of FIG. 13, including reinforcing straps.

Figure 20:
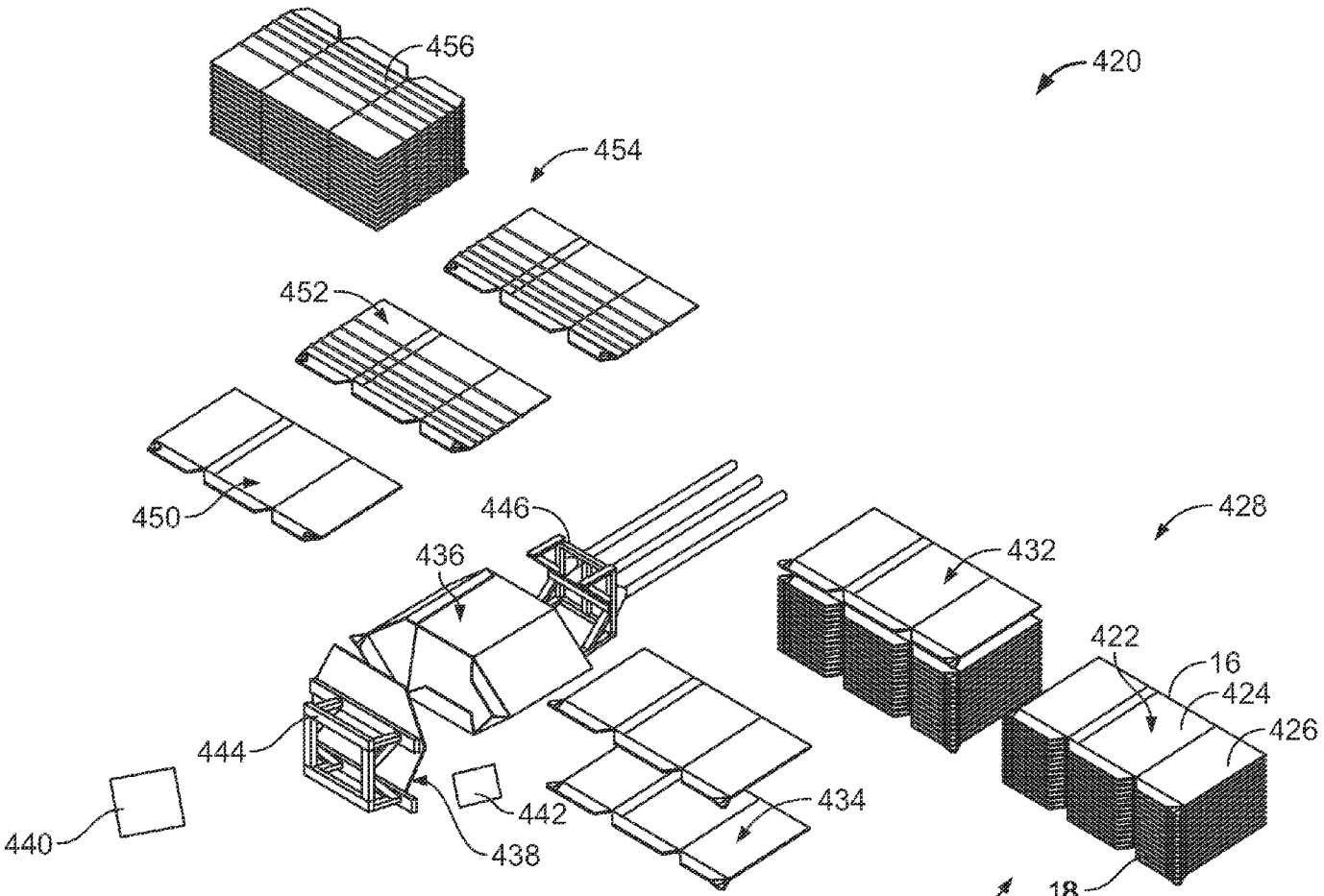
FIG. 20 is a top view of a schematic illustration of an alternative embodiment of a mechanism for producing a knocked-down flat and applying reinforcing straps around the knocked-down flat.

FIG. 20 is a schematic illustration of an alternative method of forming knocked-down flat 350, and a mechanism to perform the method. More specifically, FIG. 20 is a schematic illustration of a machine 420 for producing knocked-down flat 350 and applying reinforcing straps 210 around knocked-down flat 350. In one embodiment, machine 420 includes a plurality of stations, which contribute to forming knocked-down flat 350, as described herein.

The term "rollers" generally refer to a powered conveyor or any type of transport mechanism that may be used to advance a blank as described herein.

Machine 420 includes a bin body pre-stage station 422, for receiving a stack of bin body blanks 424 (i.e., first blank of sheet material 300 of FIG. 11). Stack 424 includes a plurality of individual bin body blanks 426. In one embodiment, stack 424 includes eighty-eight bin body blanks 426. In an alternative embodiment, stack 424 includes any suitable number of blanks that may be formed by machine 420. In operation, an individual body blank 426 is provided to machine 420 for forming knocked-down flat 350. Stack 424 is provided to machine 420 with top edges 16 aligned with a first side 428 of machine 420, and bottom edges 18 aligned with a second side 430 of machine 420.

Machine 420 also includes a transport mechanism to move stack 424 to a bin body feed station 432. In one embodiment, the transport mechanism includes at least one of a powered conveyor, rollers, and any other mechanism suitable for moving stack 424 as described herein. Bin body feed station 432 includes a scissor lift to lift stack 424 towards a vacuum. The vacuum utilizes suction to remove one blank 426 from stack 424. Blank 426 is then moved by the vacuum to a squaring station 434. As each blank 426 is removed from stack 424, the scissor lift lifts the remaining blanks 426 on stack 424, such that the next blank 426 can be removed from stack 424 by the vacuum. The blank 426 that has been moved to squaring station 434 is squared and lowered to a plurality of rollers. The plurality of rollers then move blank 426 into an erecting station 436.

As each blank 426 is placed on squaring station 434 a bottom pad or bottom blank 438 (i.e., second blank of sheet material 320 of FIG. 12) is removed from a bottom pad magazine 440 and prepared for insertion into blank 426. While bottom pad 438 is positioned between bottom pad magazine 440 and erecting station 436, a glue applicator gun 442 applies glue to predetermined locations of bottom pad 438.

At erecting station 436, an erecting device partially erects blank 426 such that bottom pad 438 can be inserted therein. In one embodiment, the erecting device includes a pair of vacuums for suctioning a top portion and a bottom portion of blank 426. Further, bottom pad 438 is folded to a substantially ninety degree angle to provide a female end and a male end. An insertion mechanism 444 located at erecting station 436 is inserted into the female end of folded bottom pad 438, such that insertion mechanism 444 forces the male end of bottom pad 438 toward an opening in the partially erect blank 426. Insertion mechanism 444 continues to insert bottom pad 438 until bottom pad 438 is positioned entirely within blank 426. A first attachment device then folds at least one major flap toward the glued portions of bottom pad 438 and a compression device 446 applies pressure to the portions of bottom pad 438 having glue thereon. As such, the glued portions of bottom pad 438 are forced against blank 426, such that bottom pad 438 is secured to blank 426 to form knocked-down flat 350. In one embodiment, the first attachment device includes a plurality of fingers. Erecting station 436 also serves as a collapsing station where knock-down flat 350 is collapsed with bottom pad 438 glued within blank 426.

In the example embodiment, a plurality of rollers transport knocked-down flat 350 to a tab joint or minor flap sealing station 450. Glue is applied to tab joints 80 and 90 and a second attachment device folds tab joints 80 and 90 such that they are sealed against second end flap 54 and sixth end flap 70, respectively. In one embodiment, the second attachment device includes a plurality of fingers. Knocked-down flat 350 is then transferred to a strapping station 452 where a plurality of straps are applied around knocked-down flat 350. Knocked-down flat 350 is then placed on a unitizing station 454 to be stacked with other knocked-down flats 350. Knocked-down flats 350 are positioned on unitizing station 454 in an alternating configuration. Specifically, a first flat 350 is positioned such that top edge 16 is aligned with first side 428 of machine 420. A second flat 350 is then positioned on top of the first flat with bottom edge 18 aligned with first side 428 of machine 420. By alternating flats 350, the weight of flats 350 is distributed to facilitate forming a level stack 456.

The method and machine described in FIG. 20 describes forming knocked-down flat 350, which include slots 302 and tabs 322. Accordingly, after knocked-down flat 350 is formed as described above, the container can be quickly erected by moving the side panels that are in a substantially face-to-face relationship away from one another and allowing the bottom panel to be unfolded such that tabs 322 are inserted within slots 302. Although the method and machine described in FIG. 20 describes forming knocked-down flat 350, the method and machine described in FIG. 20 could also be used to form knocked-down flat 200, wherein first blank 10 and second blank 100 are used for said forming.

Figure 21:
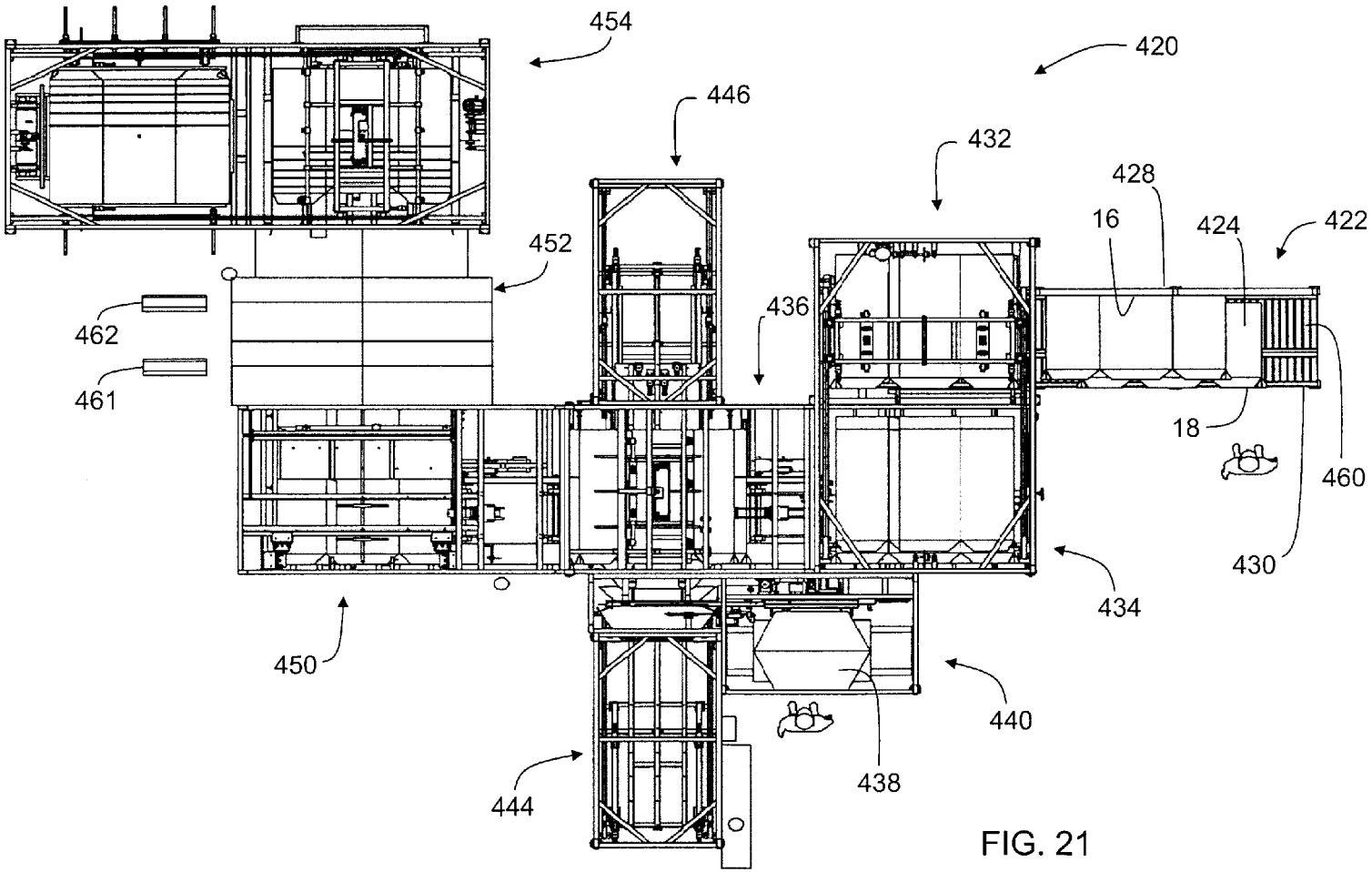
FIG. 21 is a more detailed schematic illustration of the machine shown in FIG. 20.

FIG. 21 is a more detailed schematic illustration of machine 420 as shown in FIG. 20. Machine 420 includes a bin body pre-stage station 422 coupled in communication with a bin body feed station 432. Bin body pre-stage station 422 is configured to receive stack 424 of bin body blanks 426. Specifically, pre-stage station 422 includes first side 428, second side 430, and a transport mechanism 460. Transport mechanism 460 is configured to move stack 424 to bin body feed station 432 which is coupled in communication with pre-stage station 422. In one embodiment, transport mechanism 460 includes at least one of a powered conveyor, rollers, and any other mechanism suitable for moving stack 424 as described herein. Stack 424 includes a plurality of individual bin body blanks 426, wherein each blank 426 includes top edge 16 and bottom edge 18. In one embodiment, stack 424 includes eighty-eight bin body blanks 426. In an alternative embodiment, stack 424 includes any suitable number of blanks that may be formed by machine 420.

In an alternative embodiment, machine 420 does not include bin body pre-stage station 422, but rather includes an extended conveyor system (not shown) that is coupled to bin body feed station 432. In this embodiment, stack 424 is placed on the extended conveyor system which transports stack 424 directly to bin body feed station 432. For example, stack 424 may be placed by a fork truck directly on the extended conveyor system, which transports stack 424 to bin body feed station 432 for further processing.

In operation, an individual body blank 426 is provided to machine 420 from stack 424 for forming knocked-down flat 350. Stack 424 is provided to machine 420 with top edges 16 of blanks 426 aligned with first side 428 of pre-stage station 422, and with bottom edges 18 of blanks 426 aligned with second side 430 of machine 420. Transport mechanism 460 moves stack 424 to feed station 432.

Blank 426 is then moved from bin body feed station 432 to squaring station 434. The blank 426 that has been moved to squaring station 434 is squared and lowered to a plurality of rollers. The plurality of rollers then move blank 426 into an erecting station 436. At erecting station 436, an erecting device partially erects blank 426 such that bottom pad 438 can be inserted therein and secured to blank 426 to form knocked-down flat 350. Erecting station 436 also serves as a collapsing station where knocked-down flat 350 is collapsed with bottom pad 438 glued within blank 426.

A plurality of rollers then transport knocked-down flat 350 to a tab joint or minor flap sealing station 450 and then to a strapping station 452 where a plurality of straps are applied around knocked-down flat 350. In the example embodiment, strapping station 452 includes a primary strapping head 461 and a secondary strapping head 462. Each strapping head is controlled by a controller. Strapping station 452 is configured to apply a plurality of straps around knocked-down flat 350 in a predetermined order beginning with the strap closest to top edge 16 of knocked-down flat 350. For example, as described above, strapping station 452 is configured to use primary strapping head 461 to apply strap #1 (where strap #1 is the strap farthest from the bottom of the container and strap #5 is the strap closest to the bottom of the container) to knocked-down flat 350. Strapping station 452 includes a series of primary sensors configured to detect the position of knocked-down flat 350 relative to primary strapping head 461 and at least one secondary sensor configured to detect the position of knocked-down flat 350 relative to secondary strapping head 462. The sensors communicate with the controller for strapping heads 461 and 462 such that when a sensor detects bottom edge 18 of the knocked-down flat 350, the sensor transmits data such that the primary strapping head 461 is instructed to apply a strap at a predetermined position around knocked-down flat 350. More specifically, as knocked-down flat 350 passes through strapping station 452, bottom edge 18 of knocked-down flat 350 passes each primary sensor one at a time. When a primary sensor detects bottom edge 18 of knocked-down flat 350, the sensor alerts primary strapping head 461 to apply a strap in a predetermined position around knocked-down flat 350. Knocked-down flat 350 continues through strapping station 452 in this manner until bottom edge 18 has passed each of the primary sensors. In the case where primary strapping head 461 fails to apply a strap to knocked-down flat 350 because of a malfunction or other reason, the controller associated with primary strapping head 461 records the strap that was not applied and then initiates secondary strapping head 462. More specifically, knocked-down flat 350 continues to pass through strapping station 452, and when a secondary sensor detects bottom edge 18 of knocked-down flat 350, the sensor alerts secondary strapping head 462 to apply a strap around knocked-down flat 350 in a position determined by the controller.

In an alternative embodiment, strapping station 452 may include two or more primary strapping heads and/or two or more secondary strapping heads to apply any number of straps around knocked-down flat 350 in any order.

Knocked-down flat 350 is then placed on a unitizing station 454 to be stacked with other knocked-down flats 350. Knocked-down flats 350 are positioned on unitizing station 454 in an alternating configuration.

Figure 22:
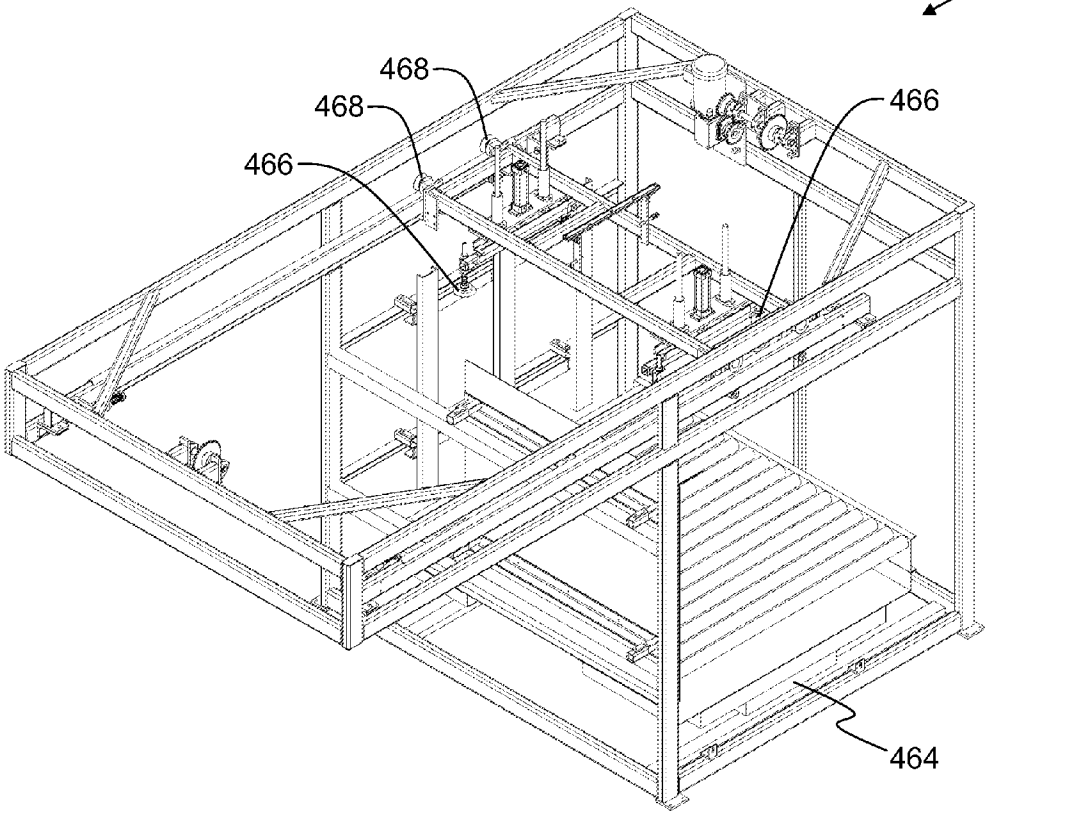
FIG. 22 is a perspective view of the bin body feed station shown in FIG. 21.

FIG. 22 is a perspective view of bin body feed station 432 for use with machine 420. Feed station 432 is coupled in communication with a squaring station 434 as described in more detail below. Feed station 432 includes a scissor lift 464, a plurality of vacuum cups 466, and a plurality of rollers 468. During operation of feed station 432, scissor lift 464 lifts stack 424 towards vacuum cups 466. Vacuum cups 466 utilize suction to remove one blank 426 from stack 424. Vacuum cups 466 and blank 426 are then moved by rollers 468 to squaring station 434, as described in more detail below.

Figure 23:
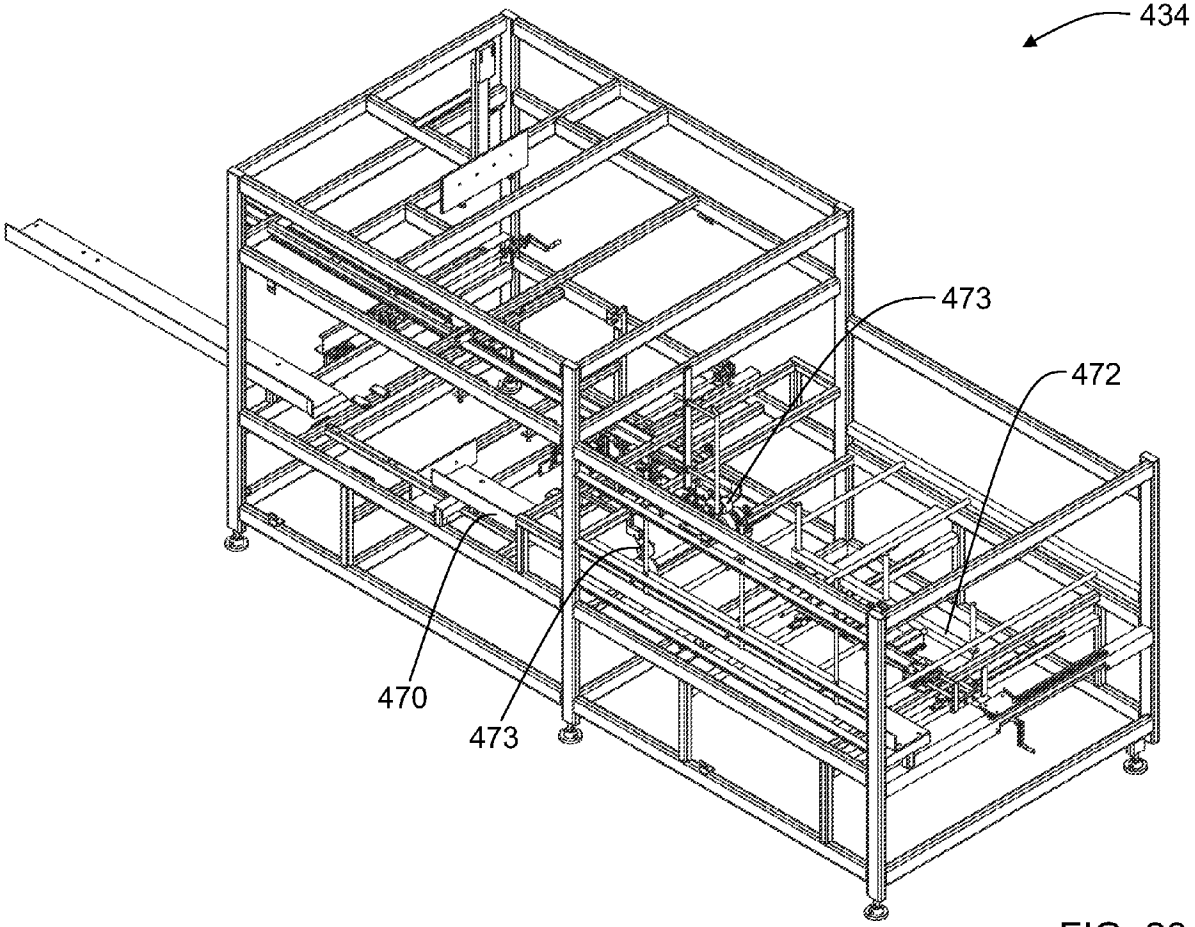
FIG. 23 is a perspective view of the squaring station shown in FIG. 21.

FIG. 23 is a perspective view of squaring station 434 for use with machine 420. Squaring station 434 is coupled in communication with a bottom pad magazine 440 and an erecting station 436. Squaring station 434 includes a rail 470, a squaring mandrel 472, and a plurality of rollers 473. During operation, squaring station 434 receives blank 426 and squares blank 426 using rail 470 and squaring mandrel 472. Specifically, bottom edge of blank (not shown) is aligned with rail 470. Rollers 473 then transport blank 426 to erecting station 436.

Figure 24:
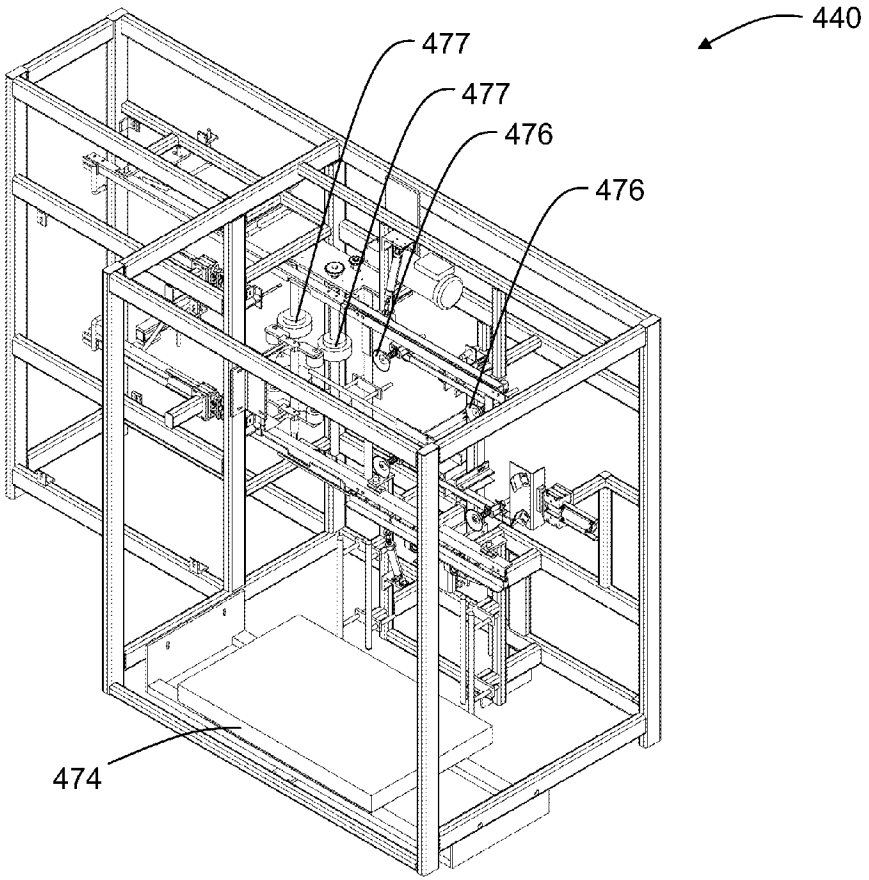
FIG. 24 is a perspective view of the bottom pad magazine shown in FIG. 21.

FIG. 24 is a perspective view of bottom pad magazine 440 for use with machine 420. Bottom pad magazine 440 is coupled to squaring station 434 and an insertion mechanism 444, as described in more detail below. In one embodiment, bottom pad magazine 440 includes a scissor lift 474, a plurality of vacuum cups 476, and a plurality of rollers 477. During operation a bottom pad or bottom blank 438 (i.e., second blank of sheet material 320 of FIG. 12) is raised by scissor lift 474 such that bottom pad 438 may be grasped by vacuum cups 476. Bottom pad 438 is rotated substantially ninety degrees prior to insertion into blank 426. Moreover, a glue applicator gun (not shown) applies glue to predetermined locations of bottom pad 438 while bottom pad 438 is positioned between bottom pad magazine 440 and inserting station 436.

Figure 25:
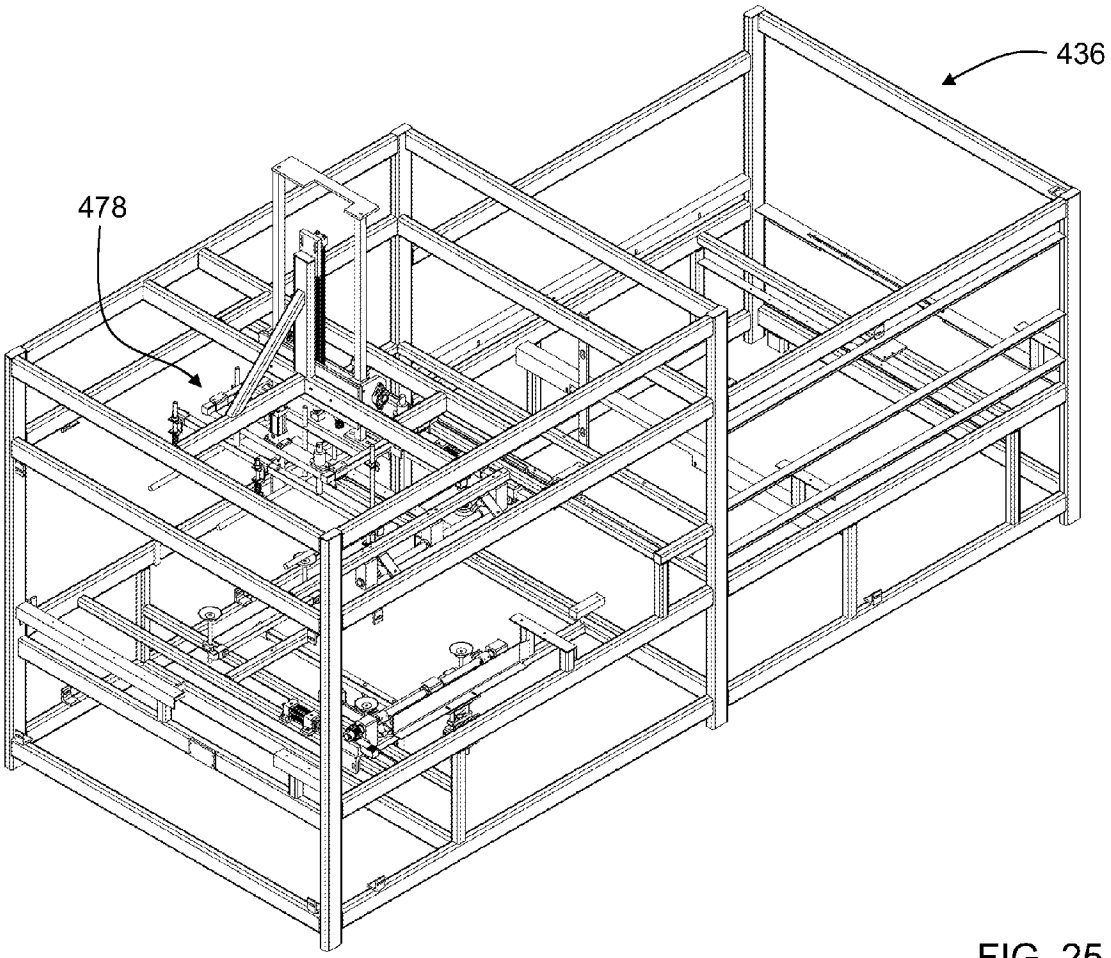
FIG. 25 is a perspective view of the inserting station shown in FIG. 21.
Figure 26:
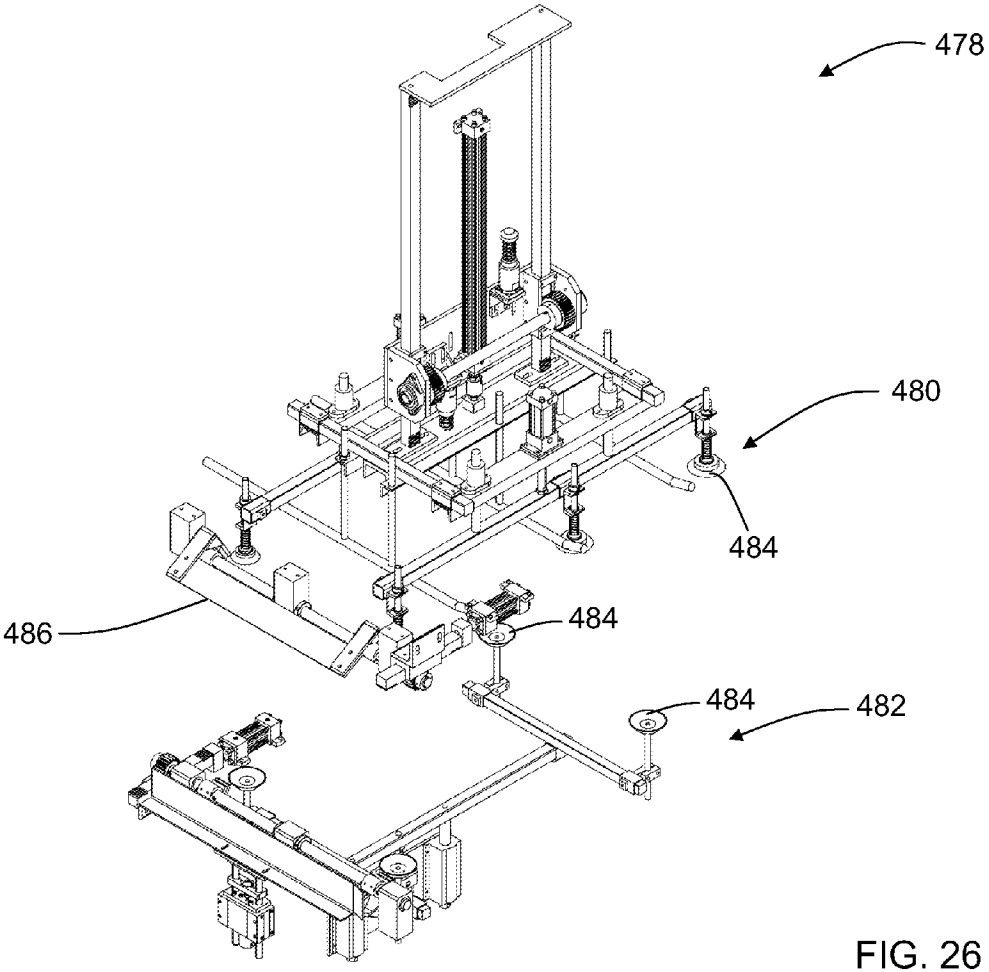
FIG. 26 is a perspective view of the erecting/collapsing device used with the inserting station shown in FIG. 25.

FIG. 25 is a perspective view of erecting station 436 for use with machine 420. FIG. 26 is a perspective view of an erecting/collapsing device 478 coupled within erecting station 436. Erecting station 436 is coupled in communication with a minor flap sealing station 450. Moreover, erecting station 436, which may also be referred to as an insertion station, is also coupled to bottom pad magazine 440, insertion mechanism 444, and a compression device 446. In one embodiment, erecting/collapsing device 478 includes a top vacuum assembly 480 and a bottom vacuum assembly 482. In one embodiment, erecting/collapsing device 478 also includes a plurality of vacuum cups 484 for suctioning a top portion and a bottom portion of blank 426.

During operation, erecting/collapsing device 478 partially erects blank 426 such that bottom pad 438 can be inserted therein. As described in more detail below, erecting/collapsing device 478 collapses blank 426 after bottom pad 438 is coupled within blank 426.

Figure 27:
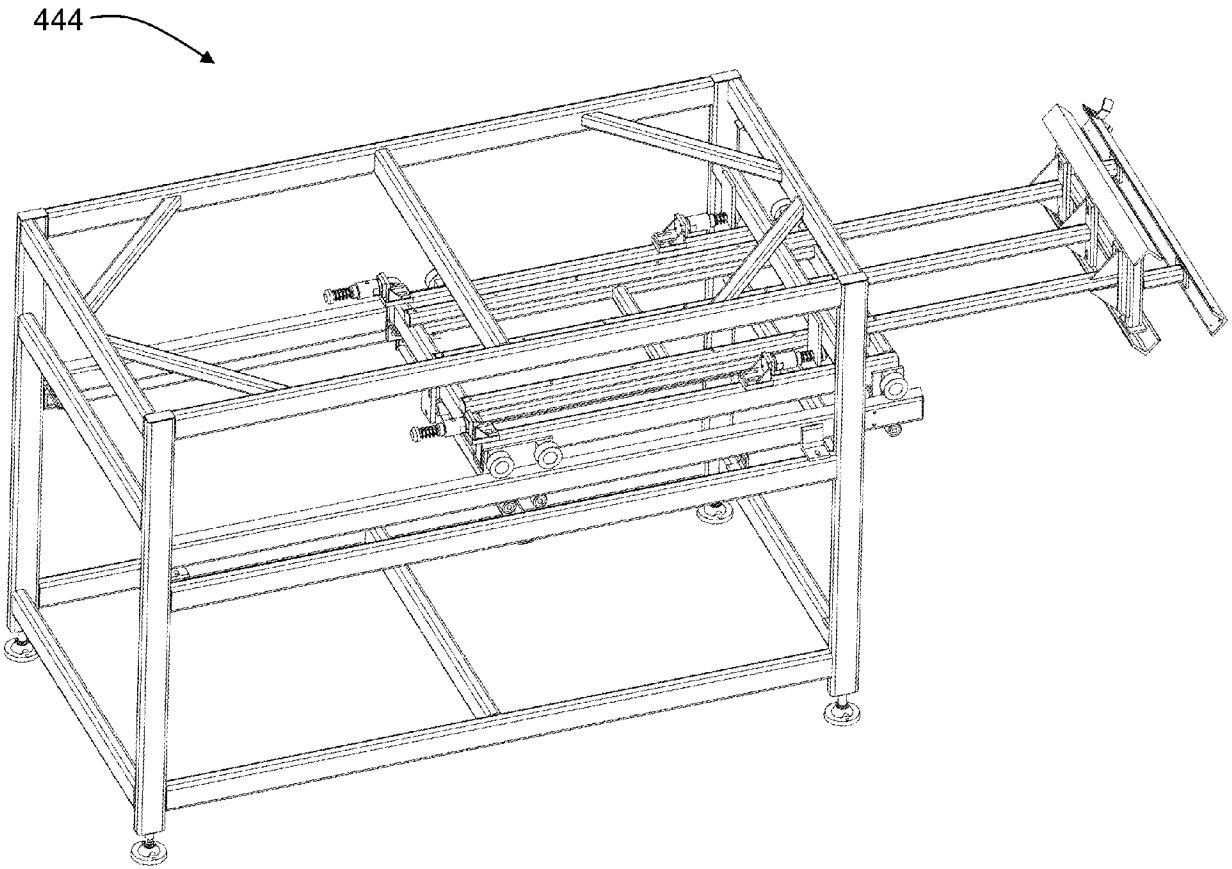
FIG. 27 is a perspective view of the insertion mechanism for use with the inserting station shown in FIG. 25.
Figure 28:
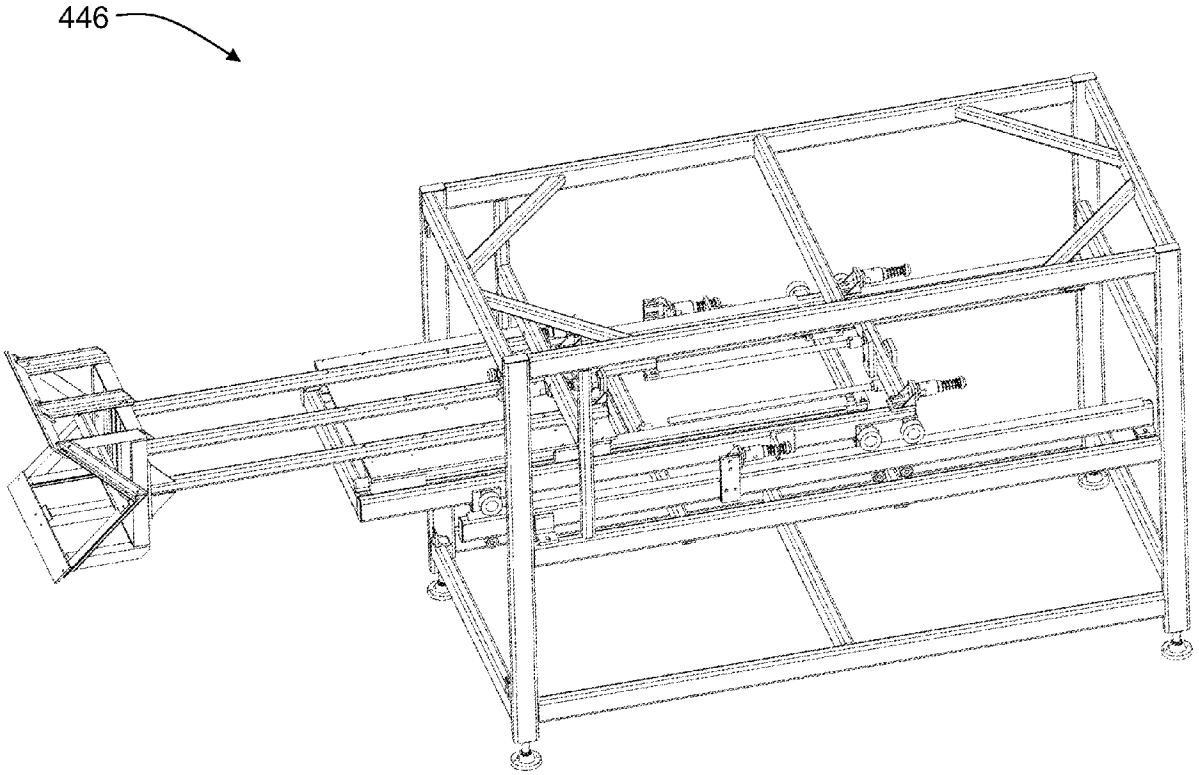
FIG. 28 is a perspective view of the compression device for use with the inserting station shown in FIG. 25.

FIG. 27 is a perspective view of insertion mechanism 444 for use with erecting station 436 to facilitate inserting bottom pad 438 into blank 426. FIG. 28 is a perspective view of compression device 446 for use with inserting mechanism 444. In one embodiment, inserting mechanism 444 includes a pair of vacuum cups (not shown) for suctioning bottom pad 438 to facilitate holding bottom pad 438. In operation, inserting mechanism 444 folds bottom pad 438 to a substantially ninety degree angle such that a female end and a male end is formed. Insertion mechanism 444 moves the male end of bottom pad 438 toward an opening (not shown) in the partially erect blank 426 until bottom pad 438 is positioned entirely therein. An attachment plate, or first finger 486 (shown in FIG. 26), couples blank 426 to bottom pad 438 by folding at least one major flap towards the glued portions of bottom pad 438. Compression device 446 applies pressure to the glued portions of bottom pad 438 to couple bottom pad 438 to blank 426 to form knocked-down flat 350. In one embodiment, first attachment device 486 includes a plurality of fingers (not shown). Knocked-down flat 350 is then collapsed with bottom pad 438 glued therein and transported to a tab joint, or minor flap sealing station 450.

Figure 29:
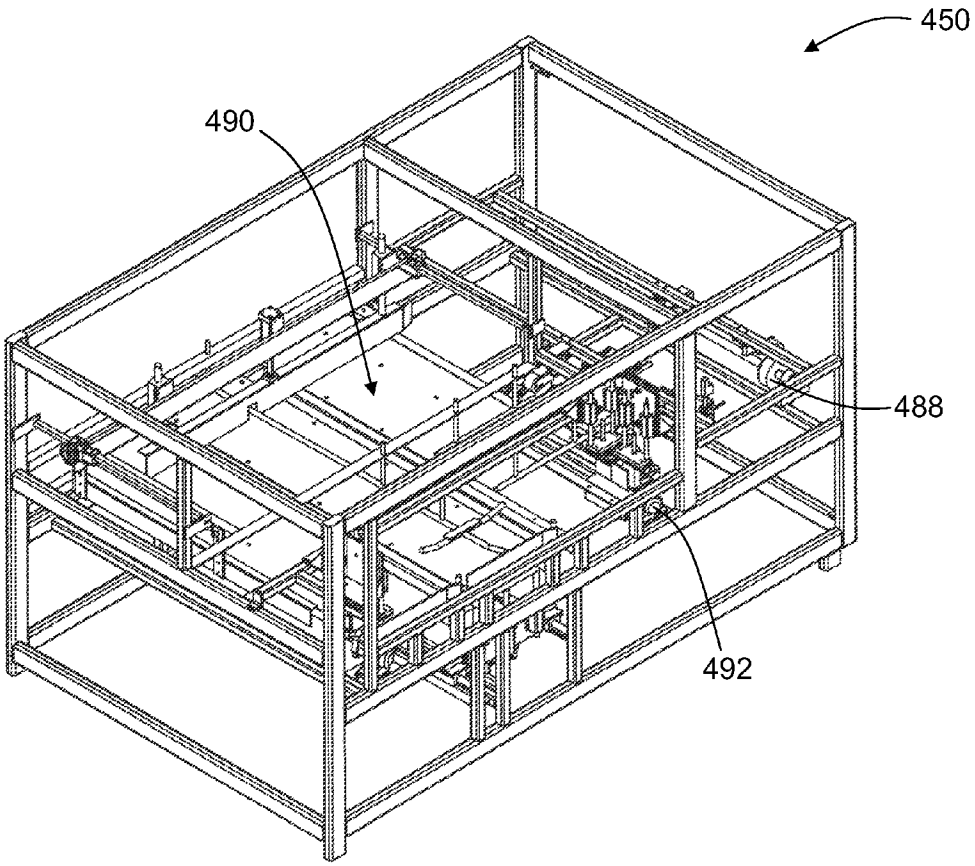
FIG. 29 is a perspective view of the minor flap sealing station shown in FIG. 21.
Figure 30:
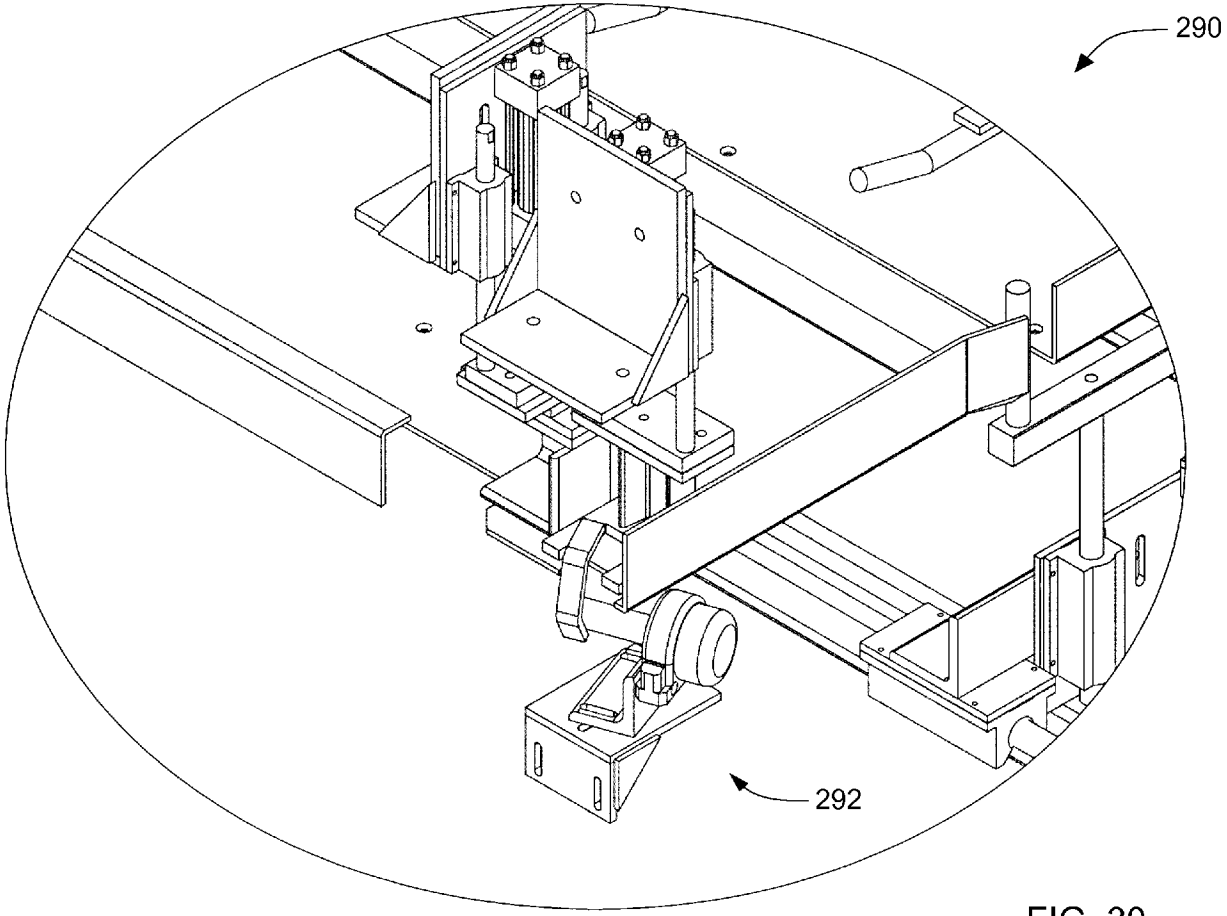
FIG. 30 is an expanded view of the second attachment device shown in FIG. 29.

FIG. 29 is a perspective view of minor flap sealing station 450 for use with machine 420. Sealing station 450 is coupled in communication with a strapping station 452 and a unitizing station 454. In one embodiment, minor flap sealing station 450 includes a plurality of rollers 488 and an attachment device 490. Glue (not shown) is applied to tab joints 80 and 90 and attachment device 490 folds tab joints 80 and 90 such that they are sealed against second end flap 54 and sixth end flap 70, respectively. In one embodiment, attachment device 490 includes a plurality of fingers 492. Knocked-down flat 350 is then transferred to strapping station 452 where reinforcing straps are applied around knocked-down flat 350. Knocked-down flat 350 is then transported to unitizing station 454 to be stacked with other knocked-down flats 350. FIG. 30 is an expanded view of attachment device 490 that includes finger 492.

Figure 31:
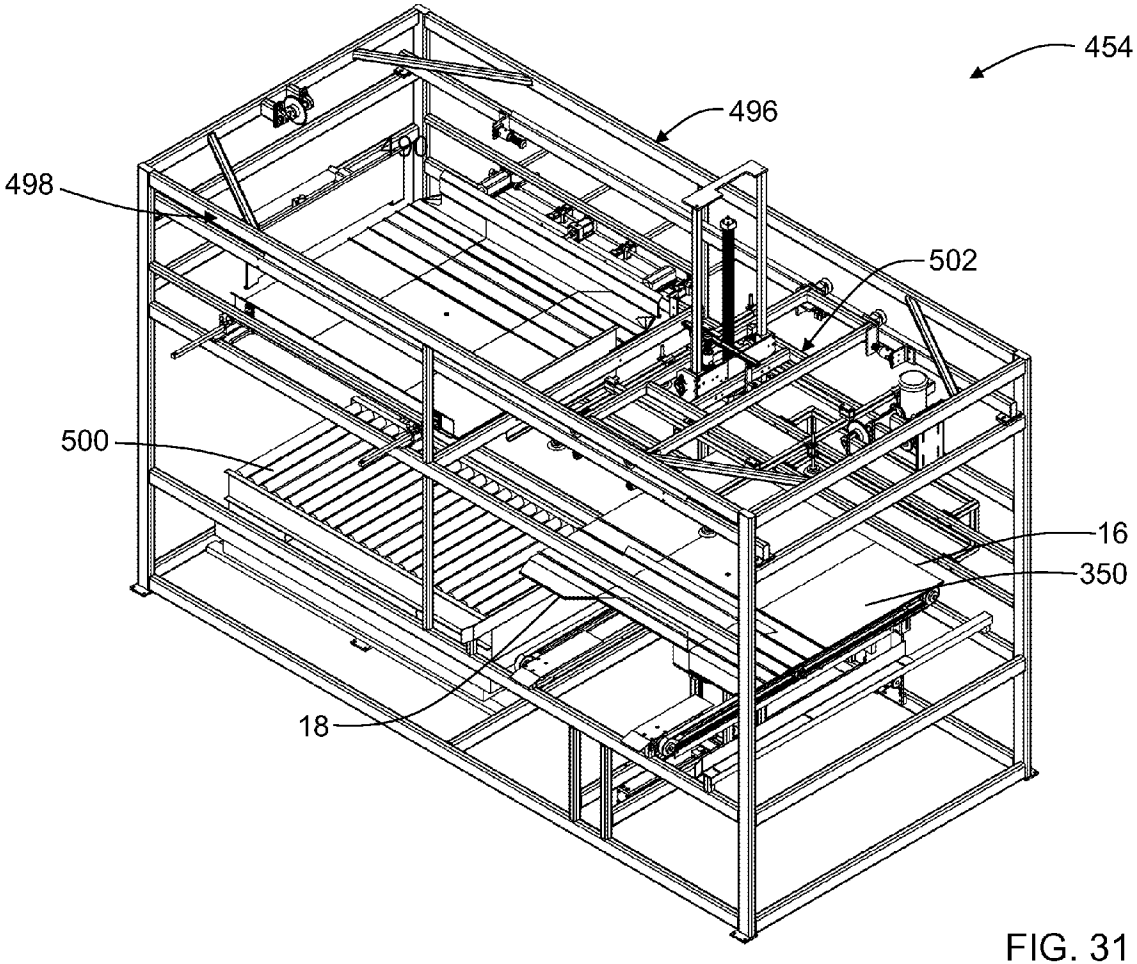
FIG. 31 is a perspective view of the unitizing station shown in FIG. 21.

FIG. 31 is a perspective view of unitizing station 454 which includes a first side 496, an opposite second side 498, a plurality of rollers 500, and a rotating device 502. In one embodiment, knocked-down flats 350 are positioned on unitizing station 454 in an alternating configuration. Specifically, a first flat 350 is positioned such that top edge 16 and bottom edge 18 are aligned with first side 496 and second side 498, respectively. A second flat 350 is then positioned on top of the first flat 350 with top edge 16 and bottom edge 18 aligned with first side 496 and second edge 498, respectively. As a result, alternating flats 350 distribute the weight of flats 350 to facilitate forming a level stack 456.

Strapping station 452 functions like strapping station 252 discussed above. Strapping station 452 may be configured to apply the straps in a plurality of locations on knocked-down flat 350. For example, in one embodiment, strapping station 452 simultaneously applies the plurality of straps around knocked-down flat 350. In an alternative embodiment, strapping station 452 applies one of the plurality of straps at a time to flat 350. In the alternative embodiment, flat 350 is positioned at a first location within strapping station 452 such that a first strap (i.e., the strap farthest away from the bottom of the container) is applied to flat 350. The conveyor transporting flat 350 is then moved to a second location within strapping station 452 such that a second strap (i.e., the strap second farthest away from the bottom of the container) is applied to flat 350. This step-by-step process of applying a strap at a location increasingly closer to the bottom of the container is repeated until all of the straps are applied. In the example embodiment, at least five straps are applied to flat 350.

The locations of the straps on the flat can vary in distance between each strap or can be the same distance between each strap. For example, numbering the straps #1, #2, #3, #4, and #5 (where #1 is the strap farthest from the bottom of the container and #5 is the strap closest to the bottom of the container), the distance between strap #1 and strap #2 is distance X, while the distance between straps #2 and #3, and between straps #3 and #4, and between straps #4 and #5 is distance Y, wherein distance X is greater than distance Y in order to provide support to the container.

As used herein, an element or step recited in the singular and proceeded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features.

The above-described apparatus and methods facilitate providing a bulk bin assembly capable of being erected and collapsed by a single person. Further, the above-described apparatus and methods provide a bulk bin assembly that is reinforced to facilitate providing strength against a weight of materials placed therein.

Although the apparatus and methods described herein are described in the context of a reinforced bulk bin assembly and method for making the same, it is understood that the apparatus and methods are not limited to reinforced bulk bin assemblies. Likewise, the reinforced bulk bin assembly components illustrated are not limited to the specific embodiments described herein, but rather, components of the reinforced bulk bin assembly can be utilized independently and separately from other components described herein.

While the invention has been described in terms of various specific embodiments, those skilled in the art will recognize that the invention can be practiced with modification within the spirit and scope of the claims.

What is claimed is:

1. A container configured to selectively move between a substantially flat configuration and a deployed configuration, the container comprising:

a plurality of side walls formed from a first blank of sheet material having a top edge and a bottom edge, the first blank comprising a plurality of side panels extending in series along a plurality of substantially parallel fold lines;

a plurality of end flaps formed from the first blank of sheet material, each end flap extending from the bottom edge of one of the plurality of side walls; and a bottom wall formed from a hexagonal second blank of sheet material, the bottom wall coupled to a first end flap of the plurality of end flaps extending from a first side wall of the plurality of side walls, the bottom wall foldable along a fold line for selectively moving the container from the deployed configuration into the substantially flat configuration, wherein a second end flap of the plurality of end flaps extends from a second side wall of the plurality of side walls adjacent the first side wall, and a third end flap of the plurality of end flaps extends from a third side wall of the plurality of side walls adjacent the second side wall, the second and third end flaps configured to releasably support at least a portion of the second blank when the container is in the deployed configuration.

2. A container in accordance with claim 1, wherein the third end flap is operatively coupled to the second end flap such that moving the container from the substantially flat configuration to the deployed configuration causes the second and third end flaps to rotate away from the second side wall and the third side wall, respectively.

3. A container in accordance with claim 1, wherein the first blank includes a tab joint coupled to the second end flap across a joint fold line, the tab joint separated from the third end flap by a cut line and adhered to the third end flap in an at least partially overlapping manner.

4. A container in accordance with claim 1, wherein the fold line in the bottom wall extends across the second blank forming a first panel and a second panel, the second blank adhered to the first end flap and an opposing fourth end flap of the plurality of end flaps such that when the container is in the substantially flat configuration, the first panel and second panel are positioned in face-to-face relationship with one another.

5. A container in accordance with claim 1, wherein the first blank further comprises at least one slot defined within at least one side panel of the plurality of side panels, and the second blank comprises a plurality of side edges and at least one tab extending from at least one side edge, the at least one tab configured to be inserted into the at least one slot when the container is in the deployed configuration.

6. A container in accordance with claim 5, wherein the at least one slot is positioned adjacent the bottom edge of the first blank.

7. A container in accordance with claim 5, wherein the at least one tab is not inserted in the at least one slot when the container is in the substantially flat configuration, and the at least one tab is inserted in the at least one slot when the container is in the deployed configuration.

8. A container in accordance with claim 1, wherein the container is a hexagonal container.

9. A container in accordance with claim 1, wherein a number of the side edges of the second blank is equal to a number of the side panels of the first blank, each of the side edges having a width substantially equal to a width of a corresponding side panel of the plurality of side panels.

10. A container in accordance with claim 1, further comprising a plurality of continuous straps positioned about an exterior surface of the plurality of side walls, each strap positioned at a predetermined location between top and bottom edges of the side walls when the container is in the deployed configuration and the substantially flat configuration.

11. A set of blanks of sheet material for forming a collapsible container, the set of blanks comprising:

a first blank configured to form a plurality of side walls of the container, the first blank comprising:

a plurality of side panels extending in series along a plurality of substantially parallel fold lines, the side panels including a first side panel, a second side panel adjacent the first side panel, and a third side panel adjacent the second side panel; and end flaps extending from a bottom fold line of each side panel, the end flaps including a first end flap extending from the first side panel, a second end flap extending from the second side panel, and a third end flap extending from the third side panel; and a hexagonal second blank configured to form a bottom wall of the container, the second blank coupled to the first end flap when the container is formed, the second blank foldable about a center fold line for selectively moving the container from a deployed configuration into a substantially flat configuration;

wherein the second and third end flaps are configured to releasably support at least a portion of the second blank when the container is in the deployed configuration.

12. A set of blanks in accordance with claim 11, wherein the third end flap is configured to be coupled to the second end flap such that moving the container from the substantially flat configuration to the deployed configuration causes each of the second and third end flaps to rotate away from the respective side panels from which the second and third end flaps extend.

13. A set of blanks in accordance with claim 11, wherein the first blank includes a tab joint coupled to the second end flap across a joint fold line, the tab joint separated from the third end flap by a cut line.

14. A set of blanks in accordance with claim 11, wherein the center fold line defines a first panel and a second panel, wherein the second blank is folded along the center fold line to position the first panel and second panel in face-to-face relationship with one another when the container is in the substantially flat configuration.

15. A set of blanks in accordance with claim 11, wherein a number of the side edges of the second blank is equal to a number of the side panels of the first blank, each of the side edges having a width substantially equal to a width of a corresponding side panel of the plurality of side panels.

16. A set of blanks in accordance with claim 11, wherein the first blank further comprises at least one slot defined within at least one side panel of the plurality of side panels, and wherein the second blank further comprises a plurality of side edges and at least one tab extending from at least one side edge, the at least one tab configured to be inserted into the at least one slot for constructing the container.

17. A set of blanks in accordance with claim 16, wherein the at least one slot is positioned adjacent at least one of the bottom fold lines.

18. A hexagonal container configured to selectively move between a substantially flat configuration and a deployed configuration, the container comprising:

a plurality of side walls formed from a first blank of sheet material having a top edge and a bottom edge, the first blank comprising a plurality of side panels extending in series along a plurality of substantially parallel fold lines;

a plurality of end flaps formed from the first blank of sheet material, each end flap extending from the bottom edge of one of the plurality of side walls; and a bottom wall formed from a hexagonal second blank of sheet material, the bottom wall coupled to a first end flap of the plurality of end flaps extending from a first side wall of the plurality of side walls, the bottom wall foldable along a fold line for selectively moving the container from the deployed configuration into the substantially flat configuration, wherein a second end flap of the plurality of end flaps extends from a second side wall of the plurality of side walls adjacent the first side wall, and a third end flap of the plurality of end flaps extends from a third side wall of the plurality of side walls adjacent the second side wall, the second and third end flaps configured to releasably support at least a portion of the second blank when the container is in the deployed configuration.

* * * * *